US011666200B2

(12) United States Patent
Liu et al.

(10) Patent No.: US 11,666,200 B2
(45) Date of Patent: Jun. 6, 2023

(54) DIVERTER VALVE ASSEMBLY, DISHWASHER, AND HOUSEHOLD APPLIANCE

(71) Applicants: FOSHAN SHUNDE MIDEA WASHING APPLIANCES MANUFACTURING CO., LTD., Guangdong (CN); MIDEA GROUP CO., LTD., Guangdong (CN)

(72) Inventors: Chaopeng Liu, Guangdong (CN); Shanshan Liu, Guangdong (CN)

(73) Assignees: FOSHAN SHUNDE MIDEA WASHING APPLIANCES MANUFACTURING CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 385 days.

(21) Appl. No.: 16/890,623

(22) Filed: Jun. 2, 2020

(65) Prior Publication Data

US 2020/0288941 A1 Sep. 17, 2020

Related U.S. Application Data

(63) Continuation of application No. PCT/CN2019/071421, filed on Jan. 11, 2019.

(30) Foreign Application Priority Data

Jan. 17, 2018 (CN) ..... 201810043908.9
Jan. 17, 2018 (CN) ..... 201820080881.6
(Continued)

(51) Int. Cl.
*A47L 15/42* (2006.01)

(52) U.S. Cl.
CPC ..... *A47L 15/4285* (2013.01); *A47L 15/4221* (2013.01); *A47L 15/4278* (2013.01); *A47L 15/4291* (2013.01)

(58) Field of Classification Search
None
See application file for complete search history.

(56) References Cited

U.S. PATENT DOCUMENTS

2004/0103926 A1 6/2004 Ha
2013/0000762 A1 1/2013 Buddharaju et al.
2014/0373876 A1 12/2014 Feddema

FOREIGN PATENT DOCUMENTS

CN 101778590 A 7/2010
CN 105286749 A 2/2016
(Continued)

OTHER PUBLICATIONS

Extended European Search Report dated Aug. 25, 2021 received in European Patent Application No. EP 19741641.5.
(Continued)

*Primary Examiner* — Levon J Shahinian
(74) *Attorney, Agent, or Firm* — Scully, Scott, Murphy & Presser, P.C.

(57) ABSTRACT

A diverter valve assembly, a dishwasher, and a household appliance are disclosed. The diverter valve assembly has a housing and a diverter valve. A water diversion chamber is formed in the housing. The housing is provided with a water inlet, a water return port, a first water outlet, and a second water outlet. The diverter valve partitions the water diversion chamber into a first chamber and a second chamber. The first chamber is communicated with the water inlet. The diverter valve is rotatable in the water diversion chamber to selectively communicate the first chamber with the water inlet and the first water outlet and communicate the second chamber with the second water outlet and the water return
(Continued)

port, or block the water inlet from the first water outlet and communicate the first chamber with the water inlet and the second water outlet.

28 Claims, 28 Drawing Sheets

(30) Foreign Application Priority Data

Dec. 26, 2018 (CN) ..... 201811602422.0
Dec. 26, 2018 (CN) ..... 201822224151.1

(56) References Cited

FOREIGN PATENT DOCUMENTS

| | | | |
|---|---|---|---|
| CN | 106468364 | A | 3/2017 |
| CN | 108185954 | A | 6/2018 |
| DE | 102015109509 | B3 | 10/2016 |
| GB | 2 023 411 | A | 1/1980 |

OTHER PUBLICATIONS

International Search Report dated Apr. 11, 2019 issued in PCT/CN2019/071421.

DIVERTER VALVE ASSEMBLY, DISHWASHER, AND HOUSEHOLD APPLIANCE

CROSS-REFERENCE TO RELATED APPLICATION

This application claims priority to and benefits of Chinese Application No. 201811602422.0, filed with the CNIPA on Dec. 26, 2018, Chinese Application No. 201822224151.1, filed with the CNIPA on Dec. 26, 2018, Chinese Application No. 201820080881.6, filed with the CNIPA on Jan. 17, 2018, and Chinese Application No. 201810043908.9, filed with the CNIPA on Jan. 17, 2018, the entire contents of which are incorporated herein by reference for all purposes. No new matter has been introduced.

FIELD

The present disclosure relates to a technical field of household appliances, and more particularly to a diverter valve assembly, a dishwasher, and a household appliance.

BACKGROUND

Generally, in order to improve a cleaning effect on tableware, a dishwasher may be usually provided with a heating device that heats washing water, so that high-temperature washing water can wash away contaminants on the tableware and supply heat to the tableware. Therefore, the dishwasher system can obtain a high cleaning and drying rate in a short washing time. However, due to the structural limitation of the system, when the washing water passes through the heating device, the flow resistance in the water channel is large, which may cause spray pressure of a spray arm of the dishwasher to drop or cause power consumption of a washing pump to increase. Only a part of the total washing time of the dishwasher involves the heating process. If the heating system is directly connected to the washing water circulation flow path, during a non-heating period, the loss due to the resistance when the water flows through the heating device may cause the spray pressure of the spray arm to decrease and the washing water flow to decrease, resulting in a poor washing effect.

SUMMARY

The present disclosure provides a diverter valve assembly, a dishwasher, and a household appliance.

The diverter valve assembly according to embodiments of the present disclosure includes a housing and a diverter valve. The housing defines a water diversion chamber therein, and is provided with a water inlet, a water return port, a first water outlet, and a second water outlet. The diverter valve is disposed in the water diversion chamber and configured to partition the water diversion chamber into a first water diversion chamber and a second water diversion chamber. The first water diversion chamber is communicated with the water inlet. The diverter valve is rotatable in the water diversion chamber to communicate the first water diversion chamber with the water inlet and the first water outlet and communicate the second water diversion chamber with the second water outlet and the water return port, or to block the water inlet from the first water outlet and communicate the first water diversion chamber with the water inlet and the second water outlet.

For the above diverter valve assembly, when the diverter valve assembly is applied to a household appliance, a heating device may be connected in a pipeline connecting the first water outlet and the water return port, and a spray arm of the household appliance may be connected to the second water outlet through a pipeline. Therefore, when water needs to be heated, the diverter valve can rotate, so that the first water diversion chamber is communicated with the water inlet and the first water outlet. In such a case, water entering through the water inlet can flow out from the first water outlet via the first water diversion chamber and be heated by the heating device, and the water heated by the heating device can flow into the second water diversion chamber from the water return port and flow to the spray arm from the second water outlet to be sprayed. When water does not need to be heated, the diverter valve can rotate, so that the water inlet is blocked from the first water outlet. In such a case, water entering through the water inlet can flow directly from the second water outlet to the spray arm via the first water diversion chamber and be sprayed. That is, the water does not pass through the heating device, which can reduce the resistance in a water flow system during a non-heating period, solve problems of huge power consumption of a washing pump and long washing time, and hence improve the system washing performance of the household appliance.

In some embodiments, the diverter valve has a first baffle, and the first baffle can open or close the first water outlet when the diverter valve rotates.

In some embodiments, the first baffle is provided with a water through hole, and when the diverter valve rotates, the first baffle can communicate the first water outlet with the first water diversion chamber by means of the water through hole.

In some embodiments, the diverter valve has a partition baffle, the partition baffle partitions the water diversion chamber into a first water diversion chamber and a second water diversion chamber, and the partition baffle can rotate in the water diversion chamber to communicate the water inlet with the first water outlet or block the water inlet from the first water outlet.

In some embodiments, the partition baffle includes a baffle body and two baffle connecting pieces connected to both sides of the baffle body, and the two baffle connecting pieces are each attached to an inner wall of the water diversion chamber.

In some embodiments, the baffle connecting pieces are arcuately connected to the inner wall of the water diversion chamber.

In some embodiments, the diverter valve has a second baffle, and the second baffle can open or close the second water outlet when the diverter valve rotates.

In some embodiments, a plurality of second water outlets are provided, a plurality of second baffles are provided, and the number of the second baffles is identical to the number of the second water outlets.

In some embodiments, two second water outlets are provided, and two second baffles are provided; the two second water outlets are spaced apart from each other, and the two second baffles are spaced apart from each other.

In some embodiments, the diverter valve includes a fixing portion, and the second baffle is detachably mounted to the fixing portion.

In some embodiments, the housing is provided with a channel, and the channel is communicated with the second water outlet; the second baffle includes a bottom plate and a first fitting portion extending upwards from the bottom plate;

the fixing portion is formed with a second fitting portion fitted with the first fitting portion; when the diverter valve rotates, the second baffle can open or close an entrance of the channel through the bottom plate to open or close the second water outlet.

In some embodiments, the diverter valve has a third baffle, and the third baffle can open or close the water return port when the diverter valve rotates.

In some embodiments, the diverter valve assembly includes a driving mechanism, and the driving mechanism is connected to the diverter valve and configured to drive the diverter valve to rotate.

In some embodiments, the diverter valve assembly includes a sensor; the driving mechanism includes a driving portion and a transmission portion; the transmission portion connects the driving portion to the diverter valve and includes a transmission member; and the sensor is used to detect a position of the transmission member.

In some embodiments, the driving portion includes an electric motor; the diverter valve includes a driving rod, and the driving rod extends downwards from a top of the diverter valve; the diverter valve is connected to the transmission member through the driving rod.

In some embodiments, the housing includes a lower housing and an upper housing, and the lower housing is connected to the upper housing.

In some embodiments, the lower housing is provided with the water inlet, the water return port, and the second water outlet; the upper housing is provided with the first water outlet.

The household appliance according to embodiments of the present disclosure includes: a chamber body, a spray arm, a heating device, and the diverter valve assembly according to any one of the above embodiments. The chamber body defines a chamber therein. The spray arm is at least partially disposed in the chamber. The second water outlet is connected to the spray arm. The heating device is connected to the first water outlet and the water return port.

In the above household appliance, when the diverter valve assembly is applied to the household appliance, the heating device may be connected in a pipeline connecting the first water outlet and the water return port, and the spray arm of the household appliance may be connected to the second water outlet through a pipeline. Therefore, when water needs to be heated, the diverter valve can rotate, so that the first water diversion chamber is communicated with the water inlet and the first water outlet. In such a case, water entering through the water inlet can flow out from the first water outlet via the first water diversion chamber and be heated by the heating device, and the water heated by the heating device can flow into the second water diversion chamber from the water return port and flow to the spray arm from the second water outlet to be sprayed. When water does not need to be heated, the diverter valve can rotate, so that the water inlet is blocked from the first water outlet. In such a case, water entering through the water inlet can flow directly from the second water outlet to the spray arm via the first water diversion chamber and be sprayed. That is, the water does not pass through the heating device, which can reduce the resistance in a water flow system during a non-heating period, solve problems of huge power consumption of a washing pump and long washing time, and hence improve the system washing performance of the household appliance.

The dishwasher according to embodiments of the present disclosure includes: a washing inner container, a spray arm, a heating device, and a diverter valve. The washing inner container is provided with a washing outlet. The spray arm is disposed in the washing inner container and provided with a spray inlet. The heating device is configured to heat washing water, and has a to-be-heated water inlet and a heated water outlet. The diverter valve is provided with a water inlet, a second water outlet, a first water outlet, and a water return port. The water inlet is connected to the washing outlet, the second water outlet is connected to the spray inlet, the first water outlet is connected to the to-be-heated water inlet, and the water return port is connected to the heated water outlet. The dishwasher includes at least two working modes. In a first mode, the water inlet of the diverter valve is communicated with the second water outlet. In a second mode, the water inlet of the diverter valve is communicated with the first water outlet, and the water return port is communicated with the second water outlet.

In the above dishwasher, by providing the diverter valve, the washing water does not flow through the heating device during a non-heating period, such that the water flow resistance can be reduced, the washing performance can be improved, and the system piping is simple and compact.

In some embodiments, a plurality of spray arms are provided, and the spray inlet of each spray arm is communicated with the second water outlet.

In some embodiments, a plurality of spray arms are provided, a plurality of second water outlets are provided, and each second water outlet is communicated with the spray inlet of at least one spray arm.

In some embodiments, a plurality of second water outlets are provided; in the first mode, the water inlet is selectively communicated with at least one second water outlet; in the second mode, the water return port is selectively communicated with at least one second water outlet.

In some embodiments, two second water outlets are provided. In the first mode, the water inlet is communicated with one of the second water outlets, or the water inlet is communicated with the other one of the second water outlets, or the water inlet is simultaneously communicated with both of the second water outlets. In the second mode, the water return port is communicated with one of the second water outlets, or the water inlet is communicated with the other one of the second water outlets, or the water inlet is simultaneously communicated with both of the second water outlets.

In some embodiments, the spray arm includes: a lower spray arm provided at a lower part inside the washing inner container; an upper spray arm provided at an upper part inside the washing inner container; and a middle spray arm provided at a middle part inside the washing inner container.

In some embodiments, two second water outlets are provided; a spray inlet of the lower spray arm is communicated with one of the second water outlets; a spray inlet of the upper spray arm and a spray inlet of the middle spray arm are communicated with the other one of the second water outlets.

In some embodiments, three second water outlets are provided, and the three second water outlets are connected to a spray inlet of the lower spray arm, a spray inlet of the upper spray arm, and a spray inlet of the middle spray arm, respectively.

In some embodiments, the heating device includes a compressor, a condenser, a throttling device, and an evaporator, which are sequentially connected end to end to constitute a refrigerant cycle.

In some embodiments, the condenser defines a first liquid flow channel and a second liquid flow channel therein; two ends of the first liquid flow channel are provided with the to-be-heated water inlet and the heated water outlet, respectively; two ends of the second liquid flow channel are communicated with the compressor and the throttling device, respectively.

Additional aspects and advantages of embodiments of the present disclosure will be given in part in the following descriptions, become apparent in part from the following descriptions, or be learned from the practice of the embodiments of the present disclosure.

BRIEF DESCRIPTION OF THE DRAWINGS

The above and/or additional aspects and advantages of embodiments of the present disclosure will become apparent and more readily appreciated from the following descriptions made with reference to the drawings, in which.

Figure 1:
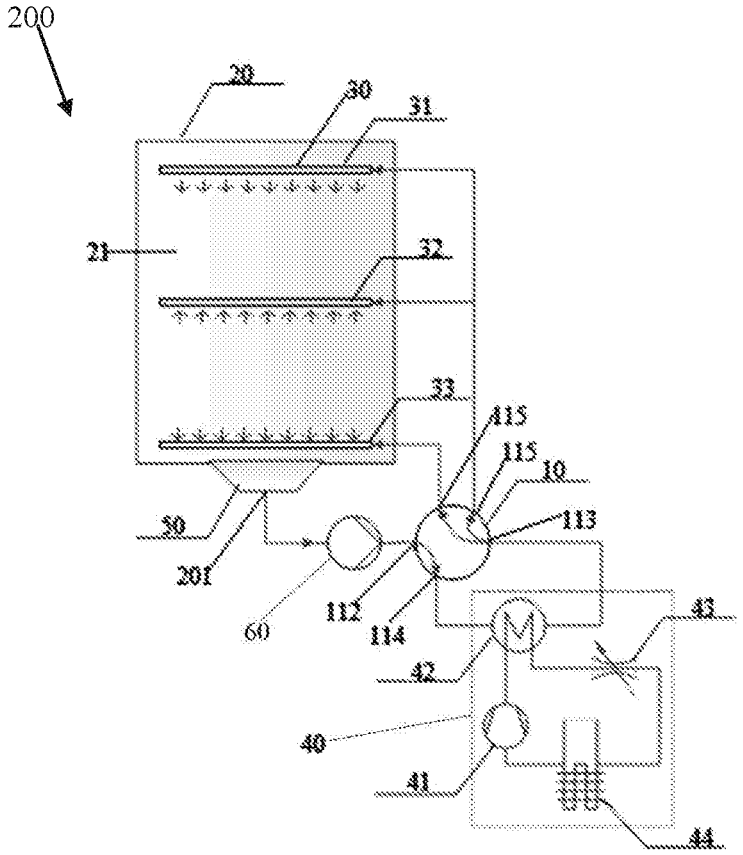
FIG. 1 is a structural diagram of a dishwasher according to an embodiment of the present disclosure.

REFERENCE NUMERALS household appliance 200;

diverter valve assembly 10, housing 11, water diversion chamber 111, inner wall 1110, first water diversion chamber 1111, second water diversion chamber 1112, water inlet 112, water return port 113, first water outlet 114, second water outlet 115, diverter valve 12, first baffle 121, water through hole 1211, partition baffle 122, baffle body 1221, baffle connecting piece 1222, second baffle 123, bottom plate 1231, first fitting portion 1232, sealing surface 1233, fixing portion 124, second fitting portion 1241, driving rod 125, third baffle 126, channel 13, entrance 131, driving mechanism 14, driving portion 141, electric motor 142, transmission portion 15, transmission member 151, sensor 16, lower housing 17, water inlet pipe 171, water return pipe 172, first water outlet pipe 173, second water outlet pipe 174, upper housing 18, fixing cover plate 19, chamber body 20, washing outlet 201, chamber 21, spray arm 30, first spray arm 31, second spray arm 32, third spray arm 33, heating device 40, compressor 41, condenser 42, throttling device 43, evaporator 44, water sump 50, washing pump 60;

dishwasher 100;

washing inner container 1, water sump 11, washing outlet 111;

upper spray arm 21, spray inlet 211 of upper spray arm 21;

middle spray arm 22, spray inlet 221 of middle spray arm 22;

lower spray arm 23, spray inlet 231 of lower spray arm 23;

heating device 3, compressor 31, condenser 32, to-be-heated water inlet 321, heated water outlet 322, throttling device 33, evaporator 34;

diverter valve 4, first interface 41, second interface 42*a* on the left, second interface 42*b* on the right, third interface 43, fourth interface 44;

washing pump 5.

DETAILED DESCRIPTION OF EMBODIMENTS

Embodiments of the present disclosure will be described in detail below, and examples of the embodiments will be illustrated in drawings. The same or similar elements and the elements having same or similar functions are denoted by like reference numerals throughout the descriptions. The embodiments described herein with reference to the drawings are explanatory and are merely used to generally understand the present disclosure. The embodiments shall not be construed to limit the present disclosure.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," and "counterclockwise" should be construed to refer to the orientation as then described or as shown in the drawings under discussion. These relative terms are for convenience of description and do not indicate or imply that the device or element referred to must have a particular orientation or be constructed and operated in a particular orientation. Thus, these terms shall not be construed to limit the present disclosure. In addition, terms such as "first" and "second" are used herein for purposes of description and are not intended to indicate or imply relative importance or significance or to imply the number of indicated technical features. Thus, the feature defined with "first" and "second" may explicitly or implicitly comprise one or more this feature. In the description of the present disclosure, "a plurality of" means two or more than two, unless specified otherwise.

In the description of the present disclosure, it should be noted that, unless specified or limited otherwise, the terms "mounted," "connected," "coupled," and the like are used broadly, and may be, for example, fixed connections, detachable connections, or integral connections; may also be mechanical or electrical connections; may also be direct connections or indirect connections via intervening structures; may also be inner communications or mutual interaction of two elements, which can be understood by those skilled in the art according to specific situations.

Figure 8:
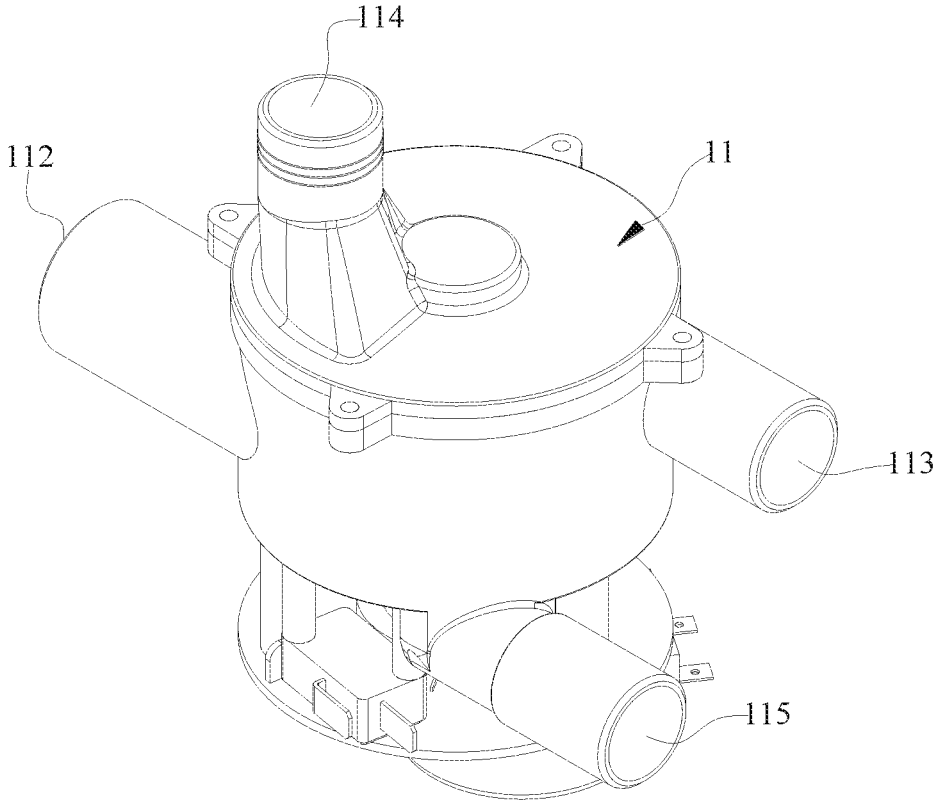
FIG. 8 is a perspective view of a diverter valve assembly according to an embodiment of the present disclosure.
Figure 9:
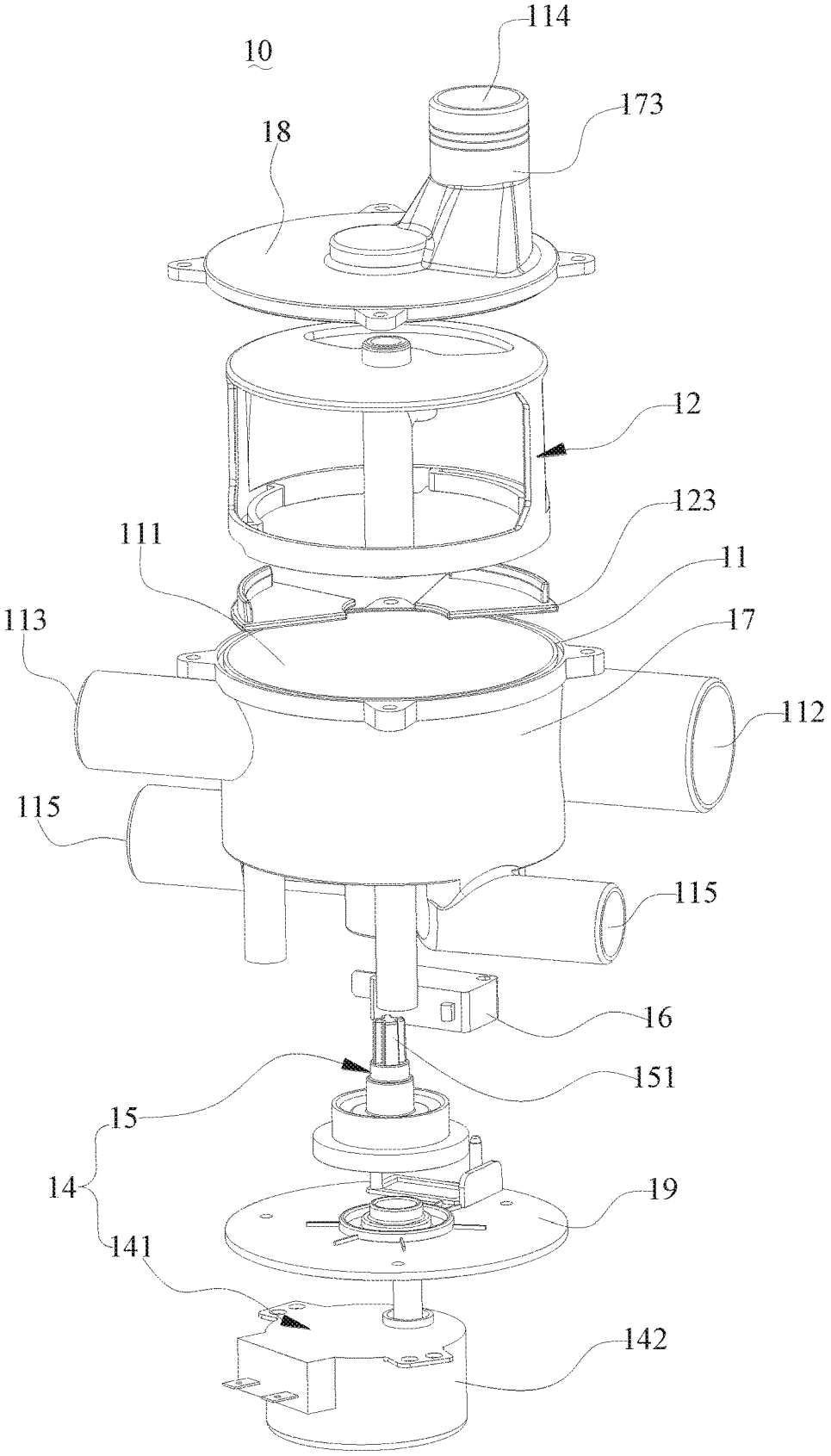
FIG. 9 is an exploded view of a diverter valve assembly according to an embodiment of the present disclosure.

Referring to FIGS. 1, 8 and 9, a diverter valve assembly 10 according to an embodiment of the present disclosure can be applied to a household appliance 200 according to an embodiment of the present disclosure. In one example, the household appliance 200 may be a dishwasher or other household cleaning apparatuses that require the use of liquids (such as water).

The household appliance 200 includes the diverter valve assembly 10, a chamber body 20, a spray arm 30, and a heating device 40. As shown in FIG. 1, the chamber body 20 defines a chamber 21 therein. The spray arm 30 is at least partially disposed in the chamber 21. The spray arm 30 is provided with a plurality of spray holes (not shown). A washing solution can be sprayed into the chamber 21 through the plurality of spray holes, to wash items (e.g., tableware) in the chamber 21. In the example shown in FIG. 1, the spray arm 30 includes a first spray arm 31, a second spray arm 32, and a third spray arm 33 spaced apart from one another. The first spray arm 31, the second spray arm 32, and the third spray arm 33 may be an upper spray arm, a middle spray arm, and a lower spray arm in sequence, respectively. The first spray arm 31, the second spray arm 32, and the third spray arm 33 can be used to clean items located at different positions in the chamber 21, respectively. The heating device 40 is used to heat washing water, and the heated washing water can be sprayed through the spray holes of the spray arm 30.

As shown in FIGS. 8 and 9, the diverter valve assembly 10 includes a housing 11 and a diverter valve 12. The housing 11 defines a water diversion chamber 111 therein. The housing 11 is provided with a water inlet 112, a water return port 113, a first water outlet 114, and a second water outlet 115. The first water outlet 114 can be communicated with (i.e., in fluid communication with) the water return port 113 through an external pipeline of the housing 11. The diverter valve 12 is disposed in the water diversion chamber 111 and can partition the water diversion chamber 111 into a first water diversion chamber 1111 and a second water diversion chamber 1112, which are spaced apart from each other. The first water diversion chamber 1111 is communicated with the water inlet 112. In operation, the diverter valve 12 can rotate in the water diversion chamber 111 to selectively provide a first operational configuration of the diverter valve 12 or a second operational configuration of the diverter valve 12.

Figure 10:
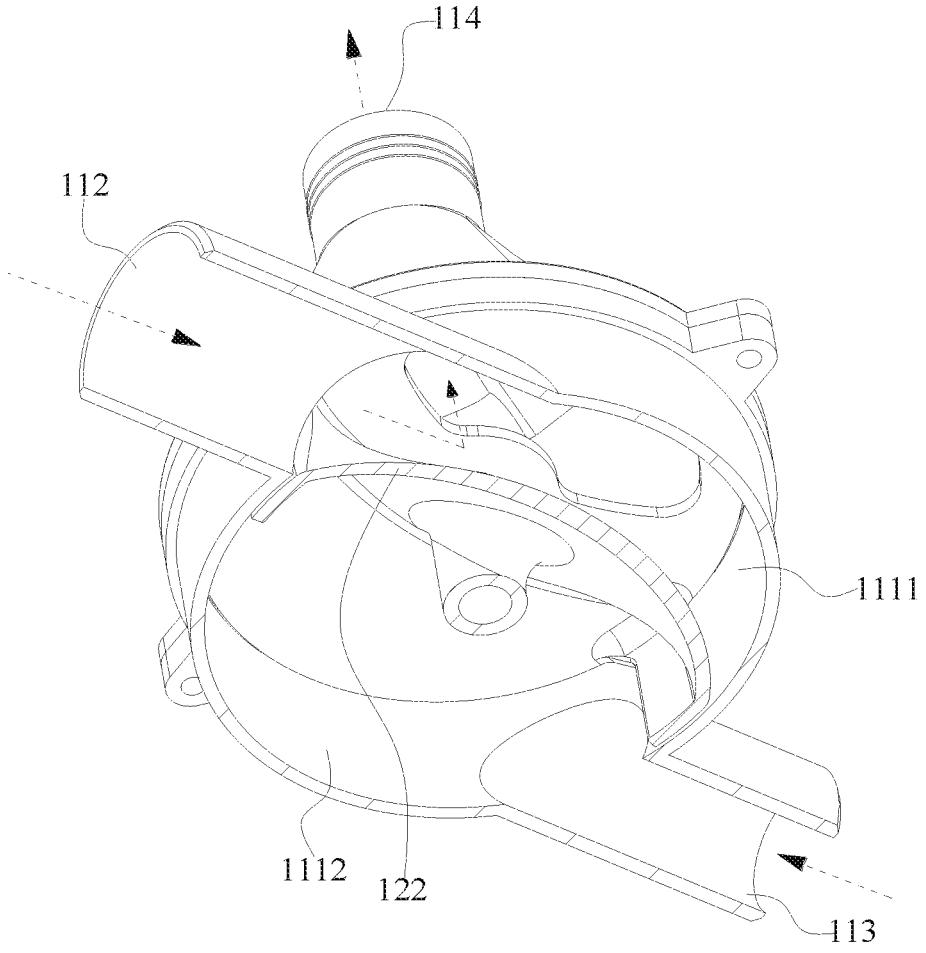
FIG. 10 is a sectional view of a diverter valve assembly in a first mode according to an embodiment of the present disclosure.
Figure 11:
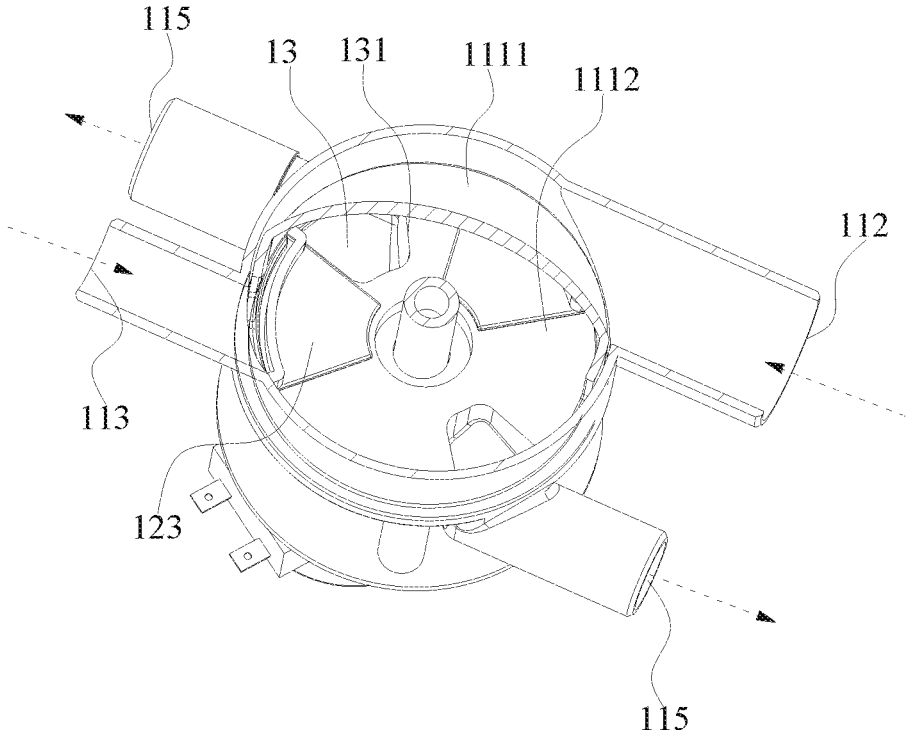
FIG. 11 is another sectional view of the diverter valve assembly in the first mode according to the embodiment of the present disclosure.
Figure 12:
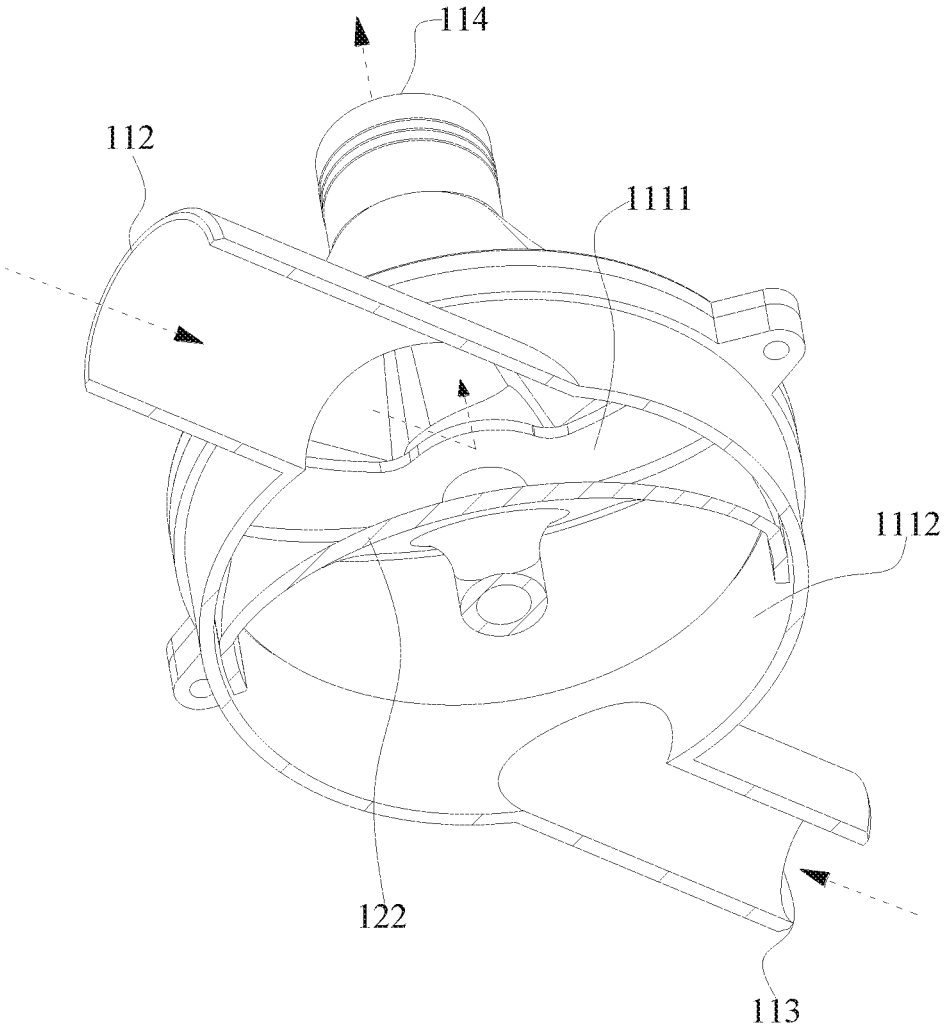
FIG. 12 is a sectional view of a diverter valve assembly in a second mode according to an embodiment of the present disclosure.
Figure 13:
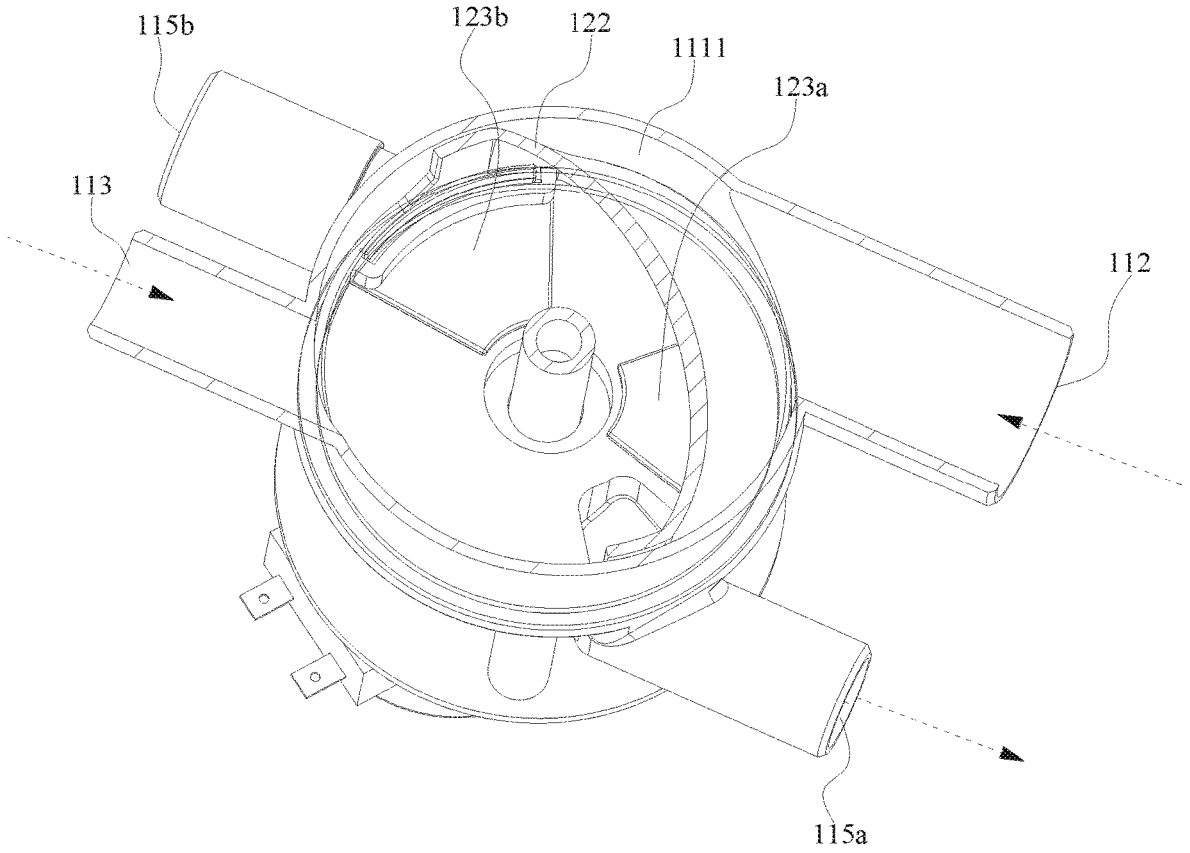
FIG. 13 is another sectional view of the diverter valve assembly in the second mode according to the embodiment of the present disclosure.

When the diverter valve 12 is in the first operational configuration, the first water diversion chamber 1111 is enabled to communicate with the water inlet 112 and the first water outlet 114 and the second water diversion chamber 1112 is enabled to communicate with the second water outlet 115 and the water return port 113, as shown in FIGS. 10 and 11. When the diverter valve 12 is in the second operational configuration, the water inlet 112 is blocked from the first water outlet 114 and the first water diversion chamber 1111 is enabled to communicate with the water inlet 112 and the second water outlet 115, as shown in FIGS. 12 and 13.

Thus, when the diverter valve 12 rotates in the water diversion chamber 111, the diverter valve assembly 10 can achieve a first state and a second state. The first state and the second state are not simultaneous. For example, when the diverter valve 12 rotates to communicate the first water diversion chamber 1111 with the water inlet 112 and the first water outlet 114, the second water diversion chamber 1112 can be communicated with the second water outlet 115 and the water return port 113, thereby realizing the first state of the water valve assembly 10. In such a case, water passing through the water inlet 112 can flow out from the first water outlet 114 via the first water diversion chamber 1111, and the water flowing out from the first water outlet 114 can flow into the second water diversion chamber 1112 via the water return port 113 and flow out from the second water outlet 115 via the second water diversion chamber 1112. When the household appliance 200 needs to use the heating device 40 for heating, the diverter valve assembly 10 can be set in the first state, and at this time the household appliance 200 can be considered to be in a heating mode. When the diverter valve 12 rotates to block the water inlet 112 from the first water outlet 114, the first water diversion chamber 1111 is communicated with the water inlet 112 and the second water outlet 115, thereby realizing the second state of the water valve assembly 10. In such a case, water passing through the water inlet 112 can directly flow out from the second water outlet 115 via the first water diversion chamber 1111. When the household appliance 200 does not need to use the heating device 40, the diverter valve assembly 10 can be set in the second state, and at this time the household appliance 200 can be considered to be in a non-heating mode.

In the present embodiment, the household appliance 200 further includes a water sump 50 and a washing pump 60, as shown in FIG. 1. The washing solution sprayed onto the washing items can be collected in the water sump 50 at the bottom of the chamber 21. A washing outlet 201 is provided in the bottom of the water sump 50. The washing solution flows out from the washing outlet 201. An inlet of the washing pump 60 is communicated with the washing outlet 201, and an outlet of the washing pump 60 is communicated with the water inlet 112, so that the washing pump 60 offers power to the circulation of the washing solution. The heating device 40 is connected to the first water outlet 114 and the water return port 113 through pipelines.

Therefore, when the diverter valve assembly 10 is applied to the household appliance 200, the spray arm 30 can be connected to the second water outlet 115 through a pipeline, so that when the water needs to be heated, the diverter valve 12 can be rotated to communicate the first water diversion chamber 1111 with the water inlet 112 and the first water outlet 114. At this time, the water entering through the water inlet 112 can flow out from the first water outlet 114 via the first water diversion chamber 1111 and be heated by the heating device 40; the water heated by the heating device 40 can flow from the water return port 113 into the second water diversion chamber 1112 and flow from the second water outlet 115 to the spray arm 30 for spraying. When the water does not need to be heated, the diverter valve 12 can be rotated to block the water inlet 112 from the first water outlet 114. At this time, the water entering through the water inlet 112 can directly flow from the second water outlet 115 via the first water diversion chamber 1111 to the spray arm 30 for spraying (that is, the water does not flow through the heating device 40), such that the resistance in a water flow system during a non-heating period can be reduced, problems of huge power consumption of the washing pump 60 and long washing time can be solved, and hence the system washing performance of the household appliance 200 can be improved.

Certainly, it could be understood that the external pipeline connecting the first water outlet 114 and the water return port 113 may also be provided with other apparatuses (for example, a plurality of heating devices), which can be set according to specific circumstances. In the example shown in FIG. 1, the heating device 40 employs a heat pump system, which includes a compressor 41, a condenser 42, a throttling device 43, and an evaporator 44. Further, the compressor 41, the condenser 42, the throttling device 43, and the evaporator 44 are connected in sequence through pipelines and constitute a closed circulation system, and a refrigerant circulates in the closed circulation system.

It could be understood that when the diverter valve 12 blocks the water inlet 112 from the first water outlet 114, the diverter valve 12 may also close the water return port 113 to block the second water outlet 115 from the water return port 113.

It should be noted that when the diverter valve 12 rotates in the water diversion chamber 111, a space corresponding to the first water diversion chamber 1111 and a space corresponding to the second water diversion chamber 1112 are both variable. A pressure of a liquid entering the first water diversion chamber 1111 from the water inlet 112 is greater than a pressure of a liquid entering the second water diversion chamber 1112 from the water return port 113 (a pressure drop loss due to liquid flow). Therefore, the first water diversion chamber 1111 can be considered as a high pressure chamber, and the second water diversion chamber 1112 can be considered as a low pressure chamber.

Figure 2:
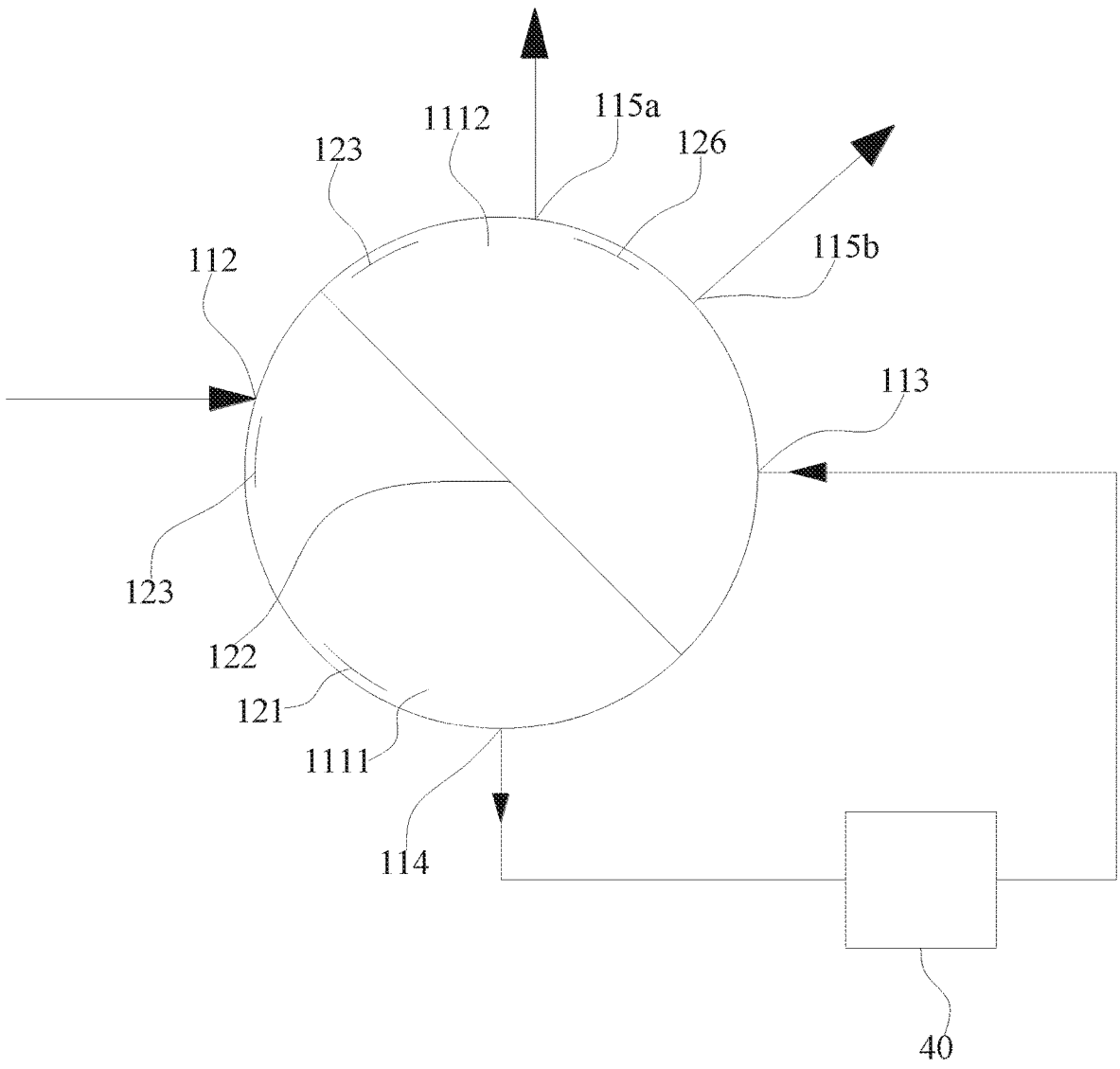
FIG. 2 is a schematic diagram of a diverter valve assembly in a first mode according to an embodiment of the present disclosure.
Figure 7:
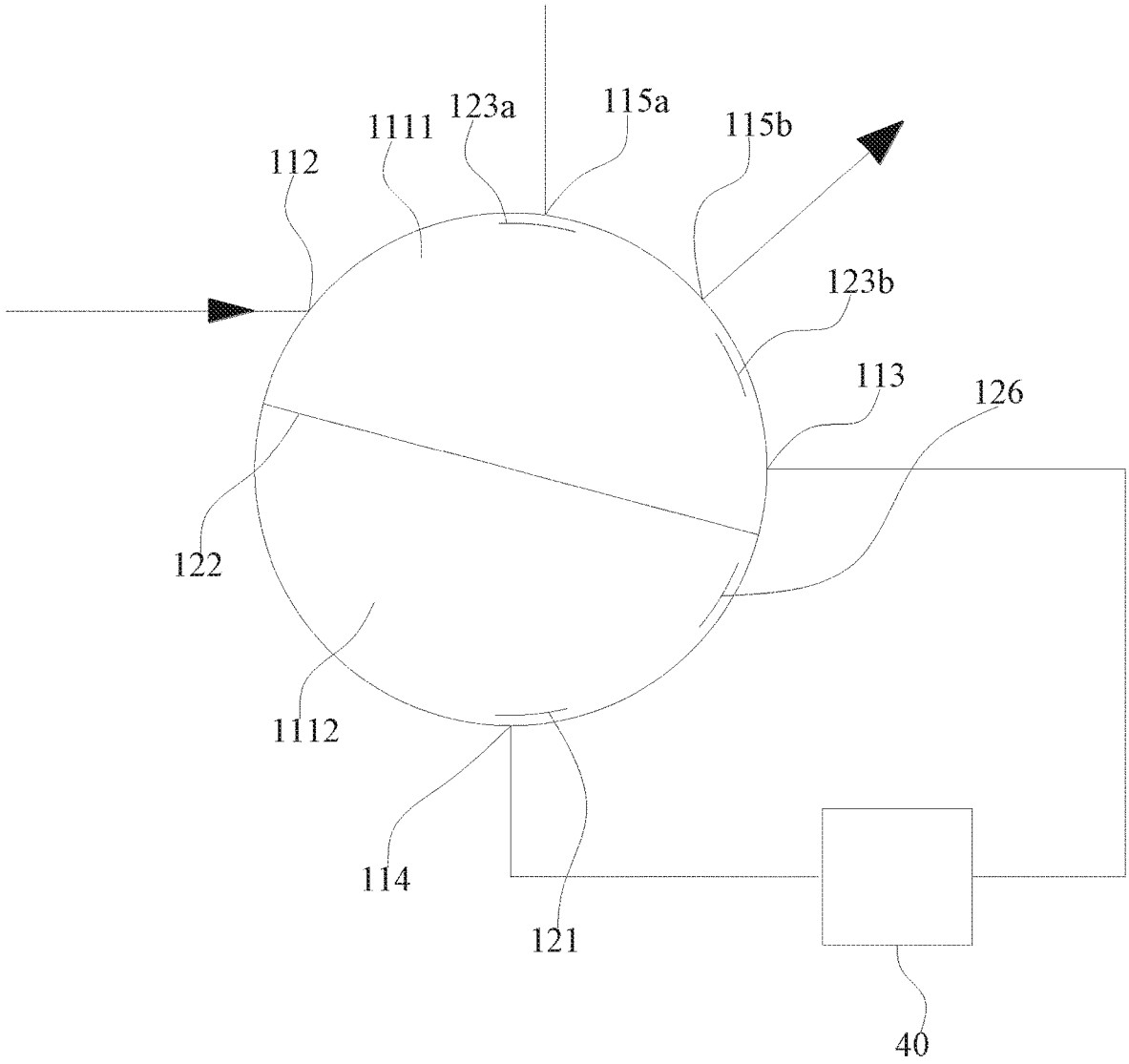
FIG. 7 is a schematic diagram of a diverter valve assembly in a sixth mode according to an embodiment of the present disclosure.

Referring to FIGS. 2 and 7, in some embodiments, the diverter valve 12 has a first baffle 121. The first baffle 121 can open or close the first water outlet 114 when the diverter valve 12 rotates. For example, in an example shown in FIG. 2, the first baffle 121 is offset or distanced from the first water outlet 114 as the diverter valve 12 rotates, thereby communicating the water inlet 112 and the first water outlet 114. For another example, in an example shown in FIG. 7, the first baffle 121 closes the first water outlet 114 to prevent the liquid from entering the heating device 40 through the first water outlet 114. It could be understood that the shape of the first baffle 121 may be set according to specific situations. For example, the first baffle 121 may be in a circular shape or an elliptical shape, or the like.

Figure 19:
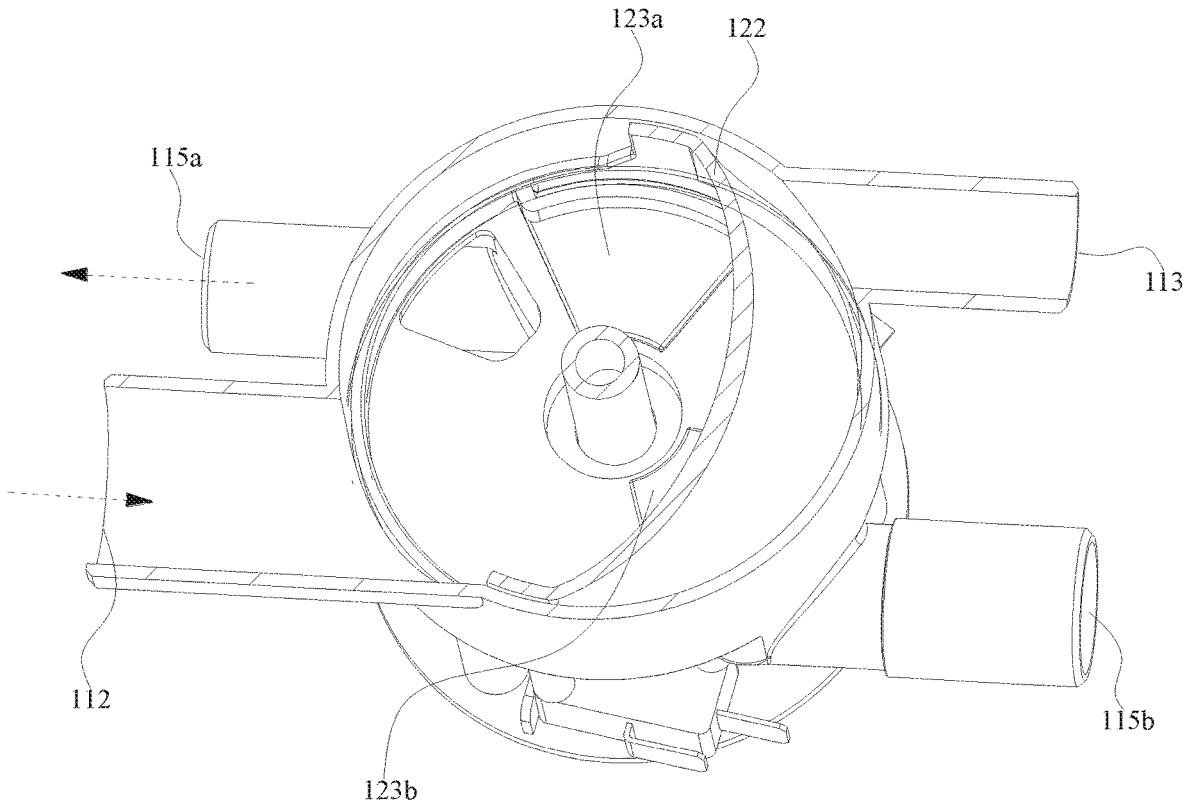
FIG. 19 is another sectional view of the diverter valve assembly in the fifth mode according to the embodiment of the present disclosure.
Figure 20:
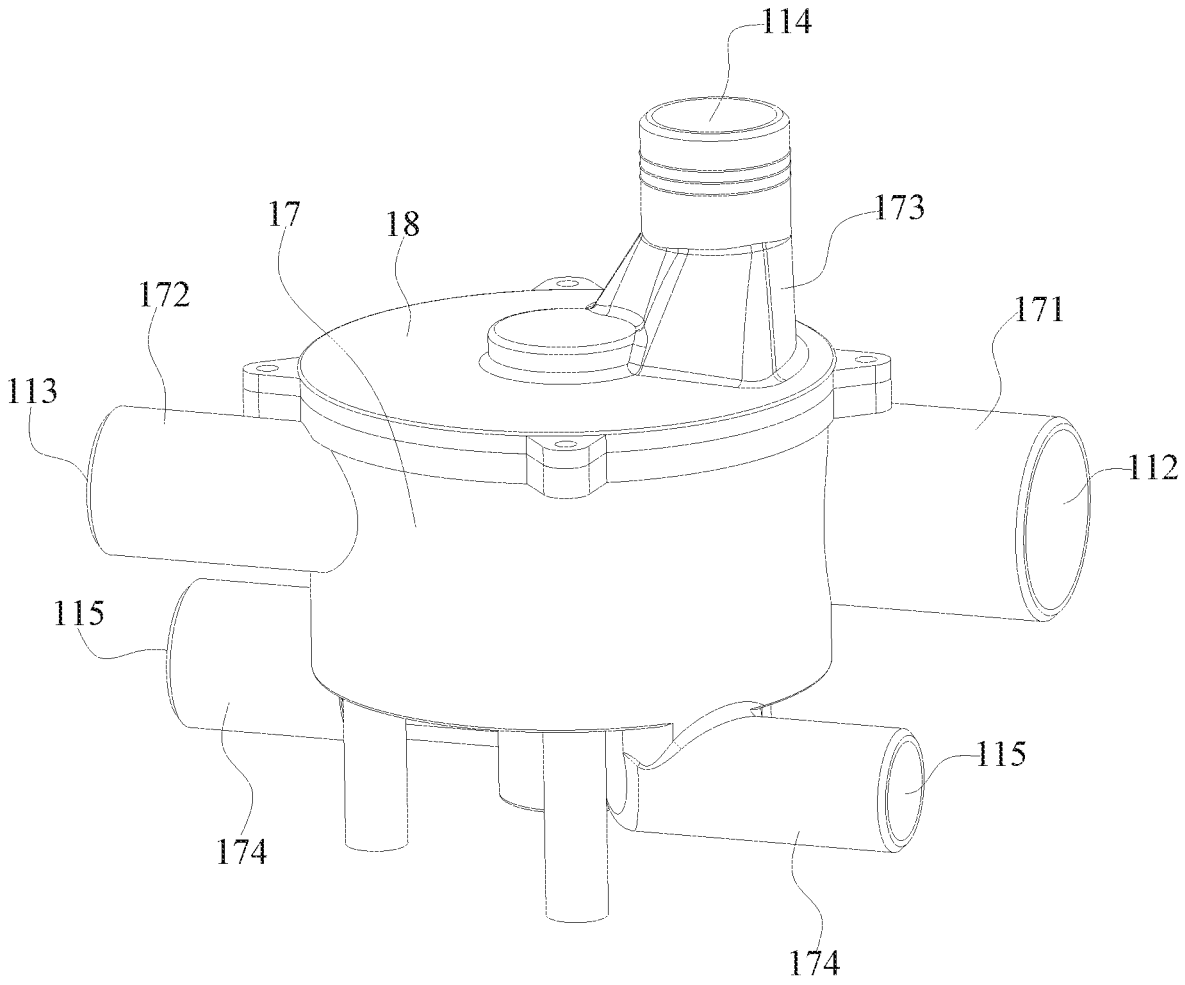
FIG. 20 is a perspective view of a housing of a diverter valve assembly according to an embodiment of the present disclosure.
Figure 21:
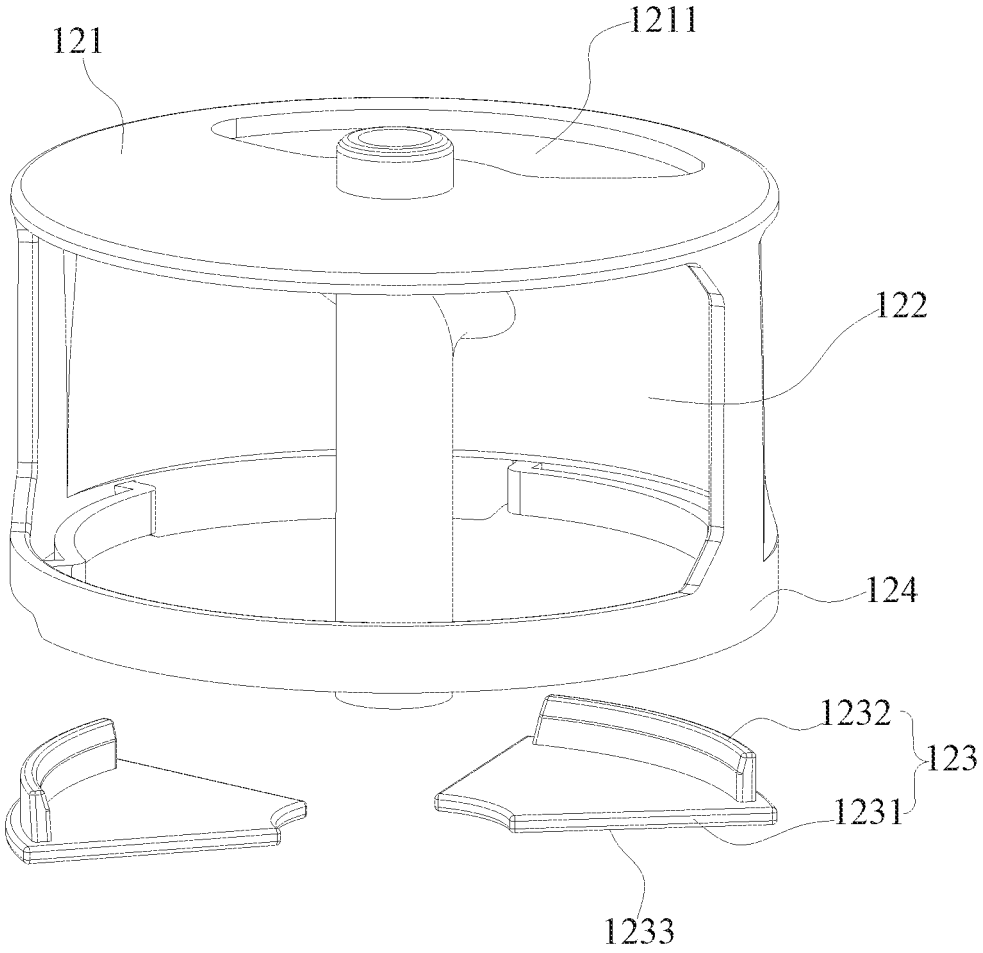
FIG. 21 is a perspective view of a diverter valve of a diverter valve assembly according to an embodiment of the present disclosure.
Figure 22:
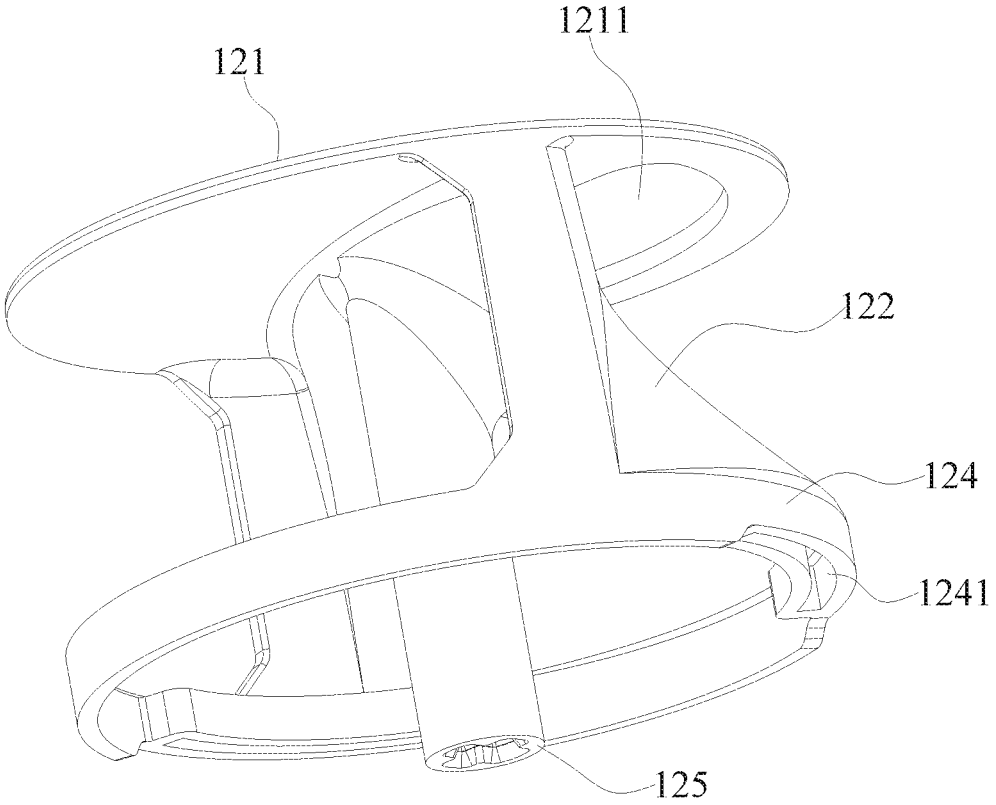
FIG. 22 is a partial perspective view of the diverter valve of the diverter valve assembly according to the embodiment of the present disclosure.

Referring to FIGS. 10-21, in some embodiments, the first baffle 121 is provided with a water through hole 1211 (referring particularly to FIG. 21). When the diverter valve 12 rotates, the first baffle 121 can communicate the first water outlet 114 with the first water diversion chamber 1111 by means of the water through hole 1211. In this way, when the water through hole 1211 is not in communication with the first water outlet 114, the first baffle 121 blocks the first water outlet 114 from the first water diversion chamber 1111. It could be understood that the water through hole 1211 can be set according to specific situations. A plurality of water through holes 1211 may be provided. For example, in an example shown in FIG. 18, the water through hole 1211 of the first baffle 121 is not in communication with the first water outlet 114, and the first water outlet 114 is closed.

In some embodiments, the diverter valve 12 has a partition baffle 122. The partition baffle 122 partitions the water diversion chamber 111 into the first water diversion chamber 1111 and the second water diversion chamber 1112. The partition baffle 122 can rotate in the water diversion chamber 111 to communicate the water inlet 112 with the first water outlet 114 or block the water inlet 112 from the first water outlet 114, selectively.

For example, when the partition baffle 122 rotates in the water diversion chamber 111 and communicates the water inlet 112 with the first water outlet 114, the diverter valve assembly 10 is in the previously-described first state or first operational configuration. When the partition baffle 122 rotates in the water diversion chamber 111 and blocks the water inlet 112 from the first water outlet 114, the diverter valve assembly 10 is in the previously-described second state or second operational configuration.

It could be understood that the shape of the partition baffle 122 may be set according to specific situations.

Figure 14:
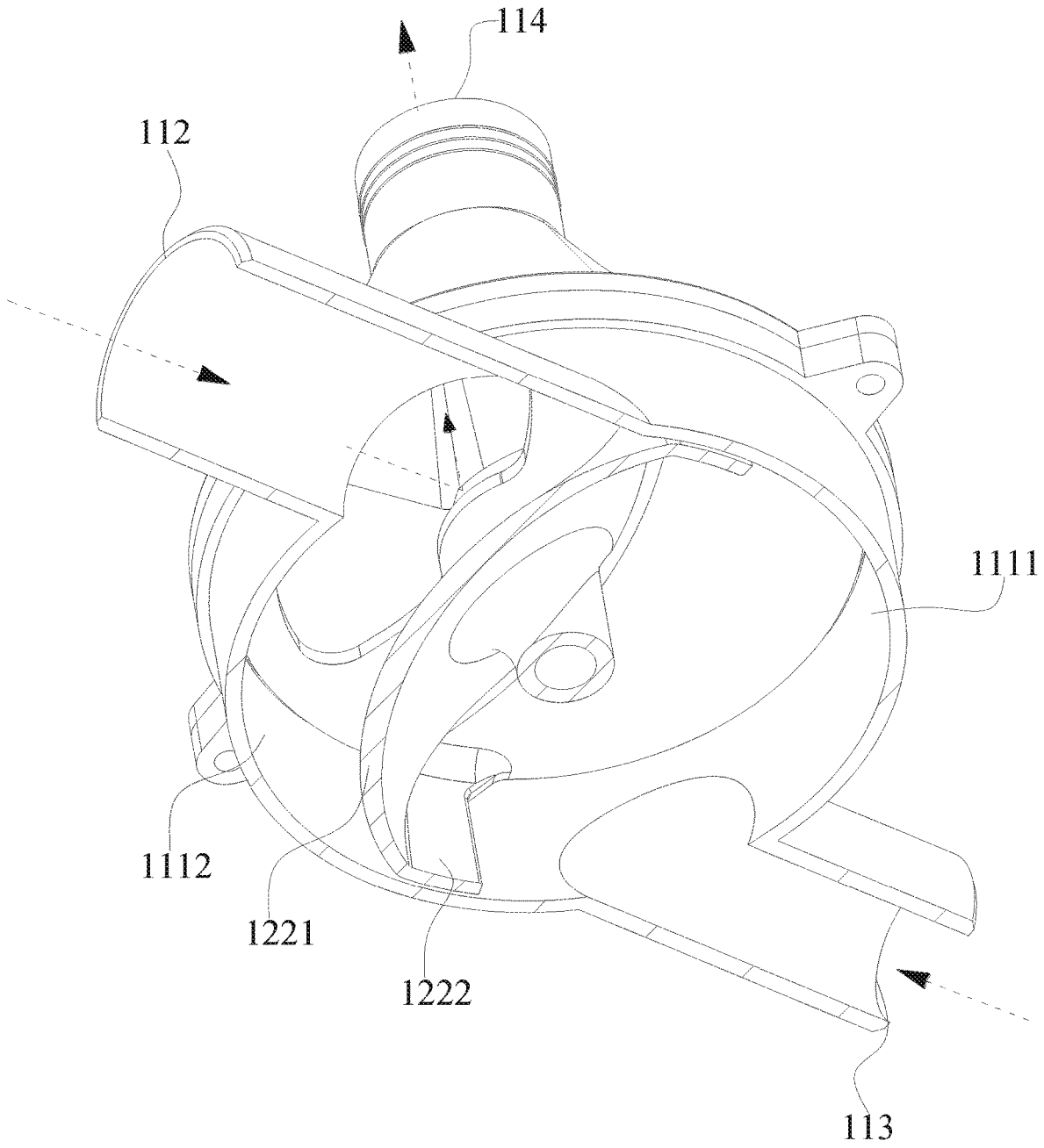
FIG. 14 is a sectional view of a diverter valve assembly in a third mode according to an embodiment of the present disclosure.
Figure 15:
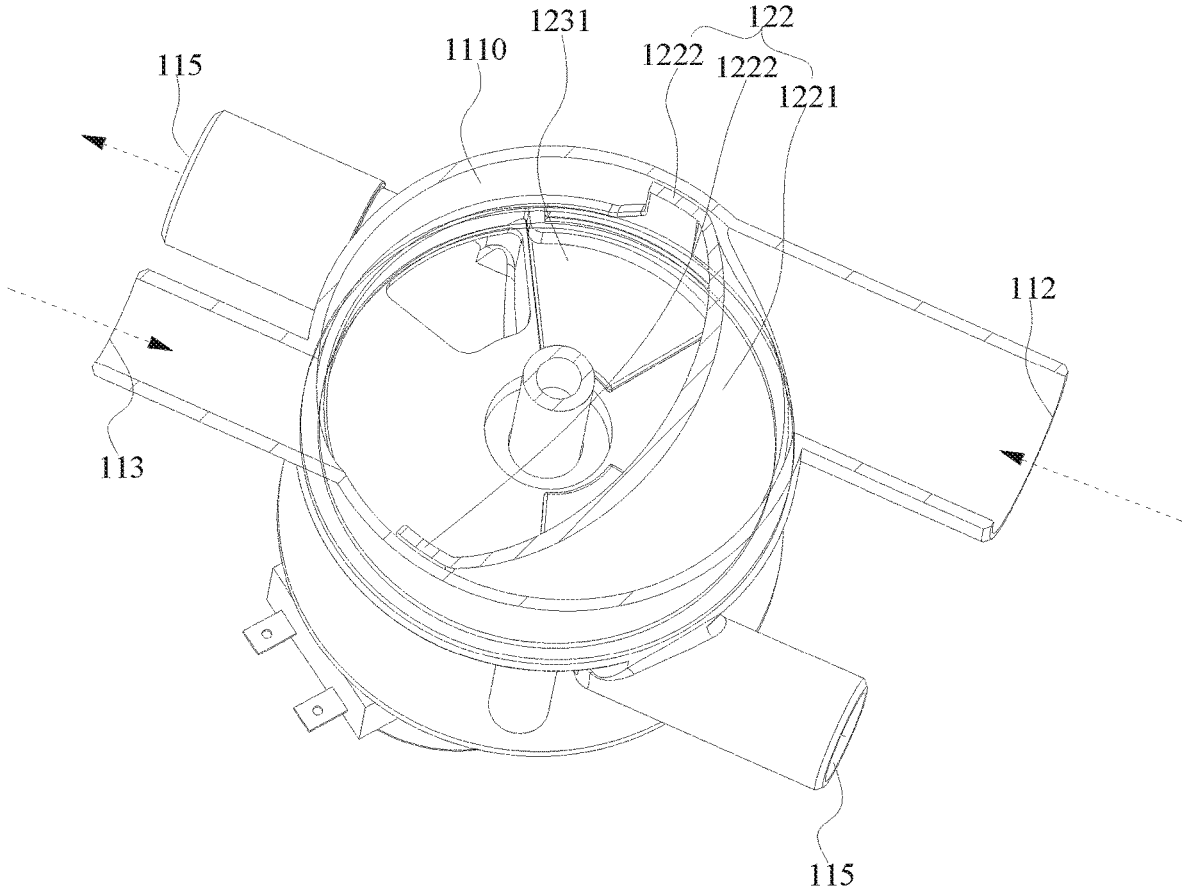
FIG. 15 is another sectional view of the diverter valve assembly in the third mode according to the embodiment of the present disclosure.

In some embodiments, the partition baffle 122 includes a baffle body 1221 and two baffle connecting pieces 1222 connected to both sides of the baffle body 1221 (see FIGS. 14 and 15). The two baffle connecting pieces 1222 are each attached to an inner wall 1110 of the water diversion chamber 111. The baffle connecting pieces 1222 are attached to the inner wall 1110 of the water diversion chamber 111 to seal gaps between the baffle connecting pieces 1222 and the inner wall 1110 of the water diversion chamber 111, so as to ensure a water diversion effect of the diverter valve assembly 10.

It could be understood that the baffle body 1221 and the two baffle connecting pieces 1222 may adopt an integral structure or a split structure.

In some embodiments, the baffle connecting piece 1222 is arcuately connected to the inner wall 1110 of the water diversion chamber 111. As a result, a better sealing effect can be achieved. For example, a first arc surface formed by the baffle connecting piece 1222 is attached to a second arc surface formed by the inner wall 1110 of the water diversion chamber 111.

Figure 16:
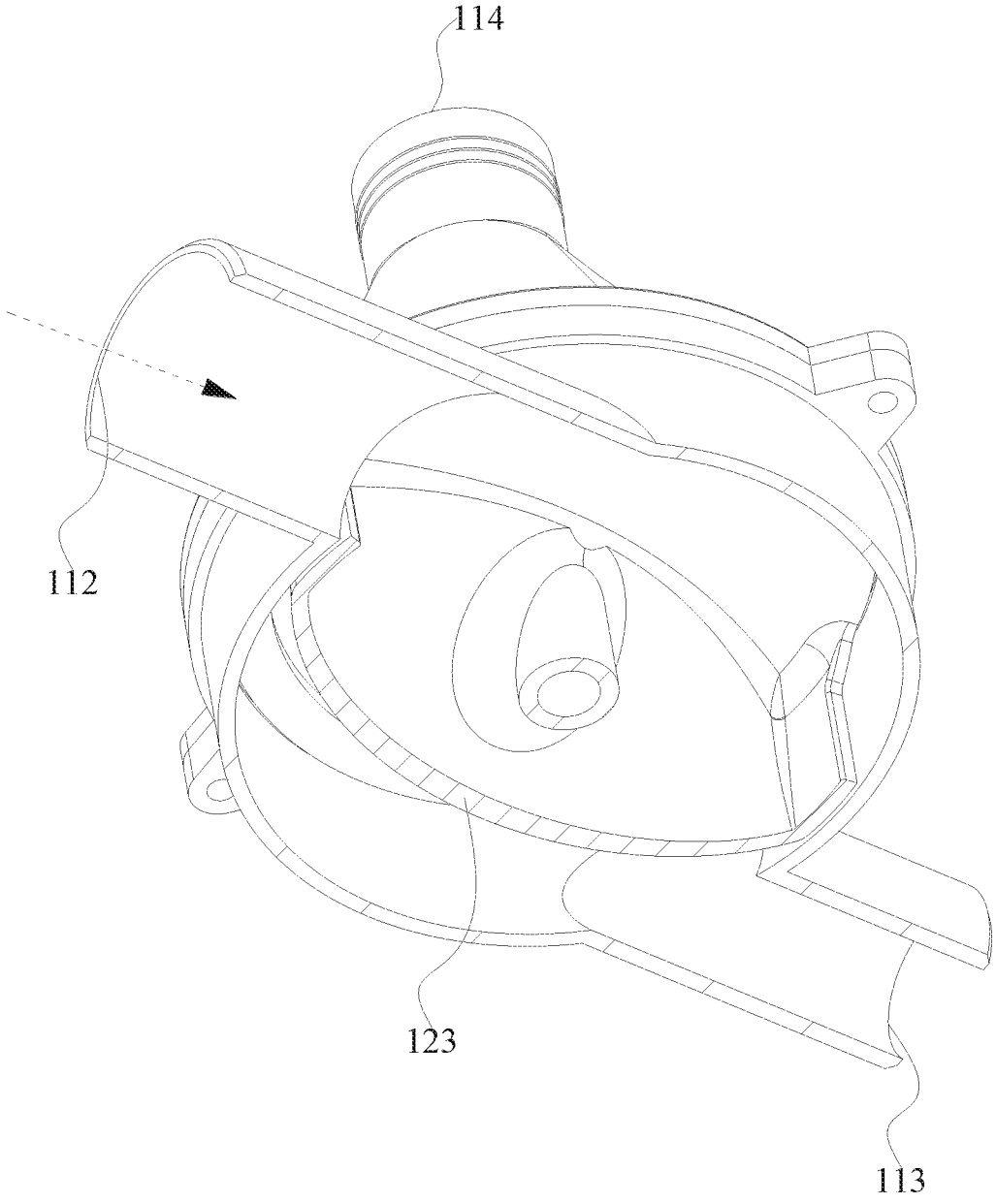
FIG. 16 is a sectional view of a diverter valve assembly in a fourth mode according to an embodiment of the present disclosure.
Figure 17:
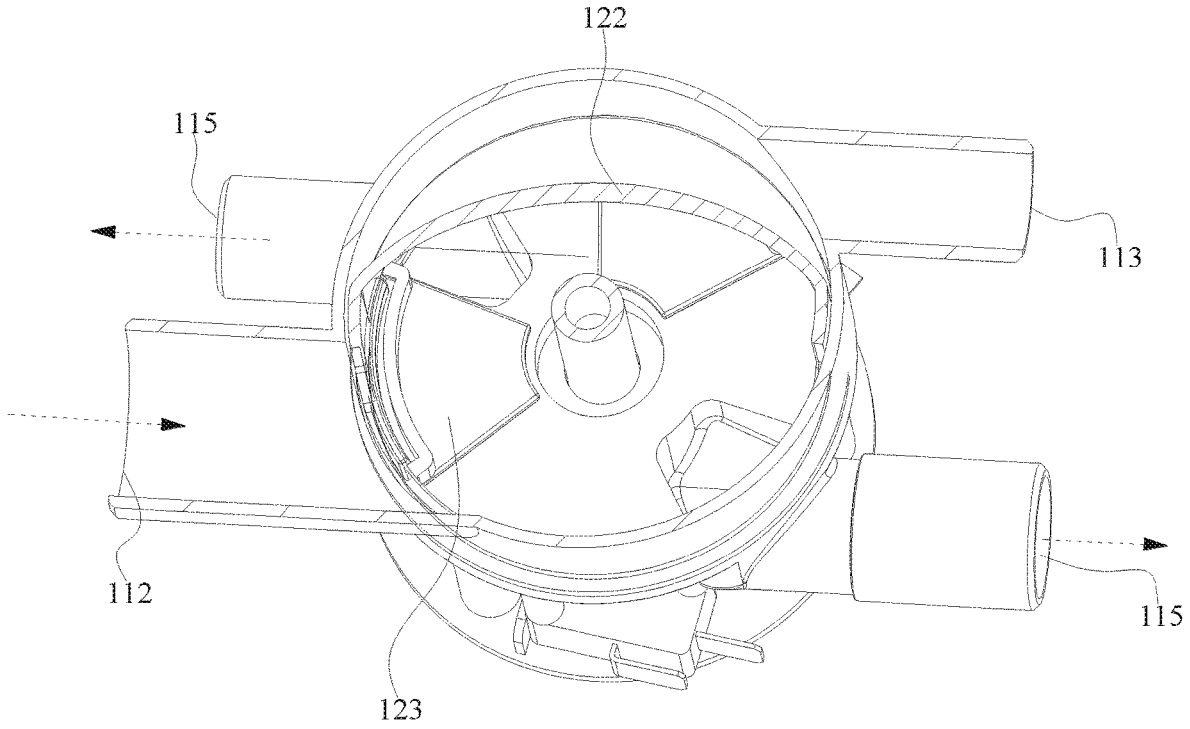
FIG. 17 is another sectional view of the diverter valve assembly in the fourth mode according to the embodiment of the present disclosure.
Figure 18:
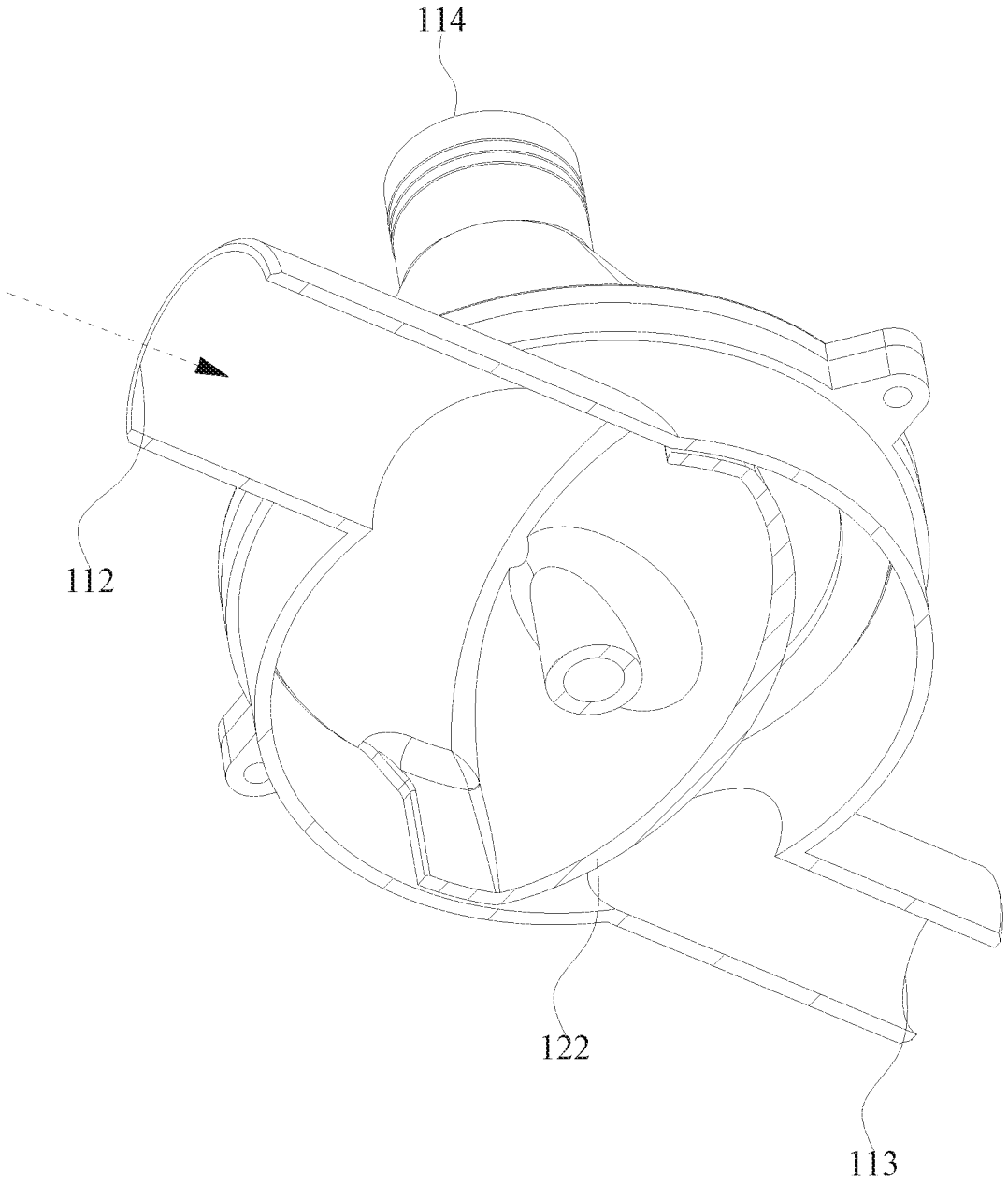
FIG. 18 is a sectional view of a diverter valve assembly in a fifth mode according to an embodiment of the present disclosure.

In some embodiments, the diverter valve 12 has a second baffle 123, as shown in FIGS. 16 and 17. The second baffle 123 can open or close the second water outlet 115 when the diverter valve 12 rotates. In this way, the opening or closure of the second water outlet 115 is implemented by the position change of the second baffle 123 along with the rotation of the diverter valve 12.

For example, when the diverter valve 12 rotates and the second baffle 123 opens the second water outlet 115, the liquid in the water diversion chamber 111 can flow out from the second water outlet 115. When the diverter valve 12 rotates and the second baffle 123 closes the second water outlet 115, the liquid in the water diversion chamber 111 is prevented from flowing out from the second water outlet 115.

In some embodiments, a plurality of second water outlets 115 are provided, a plurality of second baffles 123 are provided, and the number of the second baffles 123 is identical to the number of the second water outlets 115. In this way, different second water outlets 115 can be opened or closed by rotating the positions of the second baffles 123.

In some examples (referring to FIG. 2, FIGS. 4-7 and 9-18), two second water outlets 115 are provided, and two second baffles 123 are provided; the two second water outlets 115 are spaced apart from each other, and the two second baffles 123 are also spaced apart from each other.

In some examples, three second water outlets are provided, and three second baffles are provided. The three second water outlets are spaced apart from one another. The three second baffles are spaced apart from one another. In such a case, the number of the second water outlets of the diverter valve assembly 10 is consistent with the number of the spray arms 30 of the household appliance 200. The three second water outlets can be correspondingly connected to the first spray arm 31, the second spray arm 32, and the third spray arm 33, to realize different application modes.

Certainly, it could be understood that the number of the second water outlets may also be four, five, or etc., and the number of the second baffles may also be four, five, or etc., which are not limited herein.

Referring to FIGS. 2-7, in some embodiments, the diverter valve 12 has a third baffle 126. The third baffle 126 can open or close the water return port 113 when the diverter valve 12 rotates.

For example, in the example shown in FIG. 2, the third baffle 126 opens the water return port 113 to communicate the water return port 113 with the two second water outlets 115. For another example, in an example shown in FIG. 5, the third baffle 126 closes the water return port 113 to achieve a better sealing effect on the water return port 113.

Referring to FIGS. 2-7, the diverter valve 12 has one first baffle 121, two second baffles 123, and one third baffle 126. These baffles (one first baffle 121, two second baffles 123, and one third baffle 126) are distributed along a circumferential direction of the water diversion chamber 111 and spaced apart from one another. The partition baffle 122 partitions the water diversion chamber 111 into the first water diversion chamber 1111 and the second water diversion chamber 1112.

Referring to FIGS. 8 to 22, the diverter valve 12 has one first baffle 121 and two second baffles 123. A top of the diverter valve 12 forms the first baffle 121. The first baffle 121 has a water through hole 1211. The two second baffles 123 are detachably mounted to a bottom (i.e., a fixing portion 124) of the diverter valve 12. The two second baffles 123 are spaced apart from each other. The partition baffle 122 connects the first baffle 121 and the fixing portion 124. The partition baffle 122 partitions the water diversion chamber 111 into the first water diversion chamber 1111 and the second water diversion chamber 1112.

In the example shown in FIG. 2, when the diverter valve 12 rotates to a position shown in FIG. 2, the diverter valve assembly 10 is in a first mode. The first baffle 121 opens the first water outlet 114 as the diverter valve 12 rotates. The two second baffles 123 spaced apart from each other are offset from the two second water outlets (i.e., a second water outlet 115*a* and a second water outlet 115*b*) as the diverter valve 12 rotates, so that the second water outlet 115*a* and the second water outlet 115*b* are in an open state. The water inlet 112 and the first water outlet 114 are located on a side where the first water diversion chamber 1111 is located, while the water return port 113 and the two second water outlets are located on a side where the second water diversion chamber 1112 is located. The third baffle 126 is offset from the water return port 113 as the diverter valve 12 rotates, so as to open the water return port 113.

The first water diversion chamber 1111 is communicated with the water inlet 112 and the first water outlet 114, the first water outlet 114 is communicated with the heating device 40, and the second water diversion chamber 1112 is communicated with the two second water outlets and the water return port 113 simultaneously. In such a case, after entering through the water inlet 112, the liquid can flow out from the first water outlet 114 via the first water diversion chamber 1111, subsequently flow back to the second water diversion chamber 1112 through the water return port 113 after being heated by the heating device 40, and flow out from the two second water outlets. The flow direction of the liquid is shown by arrows in FIG. 2. In this way, the diverter valve assembly 10 can supply water through the two second water outlets simultaneously. For example, when the diverter valve assembly 10 is applied to the household appliance 200, one second water outlet 115*a* of the two second water outlets may be communicated with the third spray arm 33, and the other second water outlet 115*b* may be communicated with the first spray arm 31 and second spray arm 32. As a result, when the two second water outlets are opened simultaneously, the three spray arms of the household appliance 200 can spray heated water at the same time.

In examples shown in FIGS. 10 and 11 (in combination with FIGS. 21 and 22), the diverter valve assembly 10 is in the above first mode. The first water diversion chamber 1111 is communicated with the water inlet 112 and the first water outlet 114 through the water through hole 1211 in the first baffle 121, and the first water outlet 114 can be communicated with the heating device 40. The two second baffles 123 spaced apart from each other correspondingly open the two second water outlets 115 spaced apart from each other, as the diverter valve 12 rotates. The second water diversion chamber 1112 is communicated with the two second water outlets 115 and the water return port 113 simultaneously. The flow direction of the liquid in the diverter valve assembly 10 is shown by dotted arrows in FIGS. 10 and 11.

Figure 3:
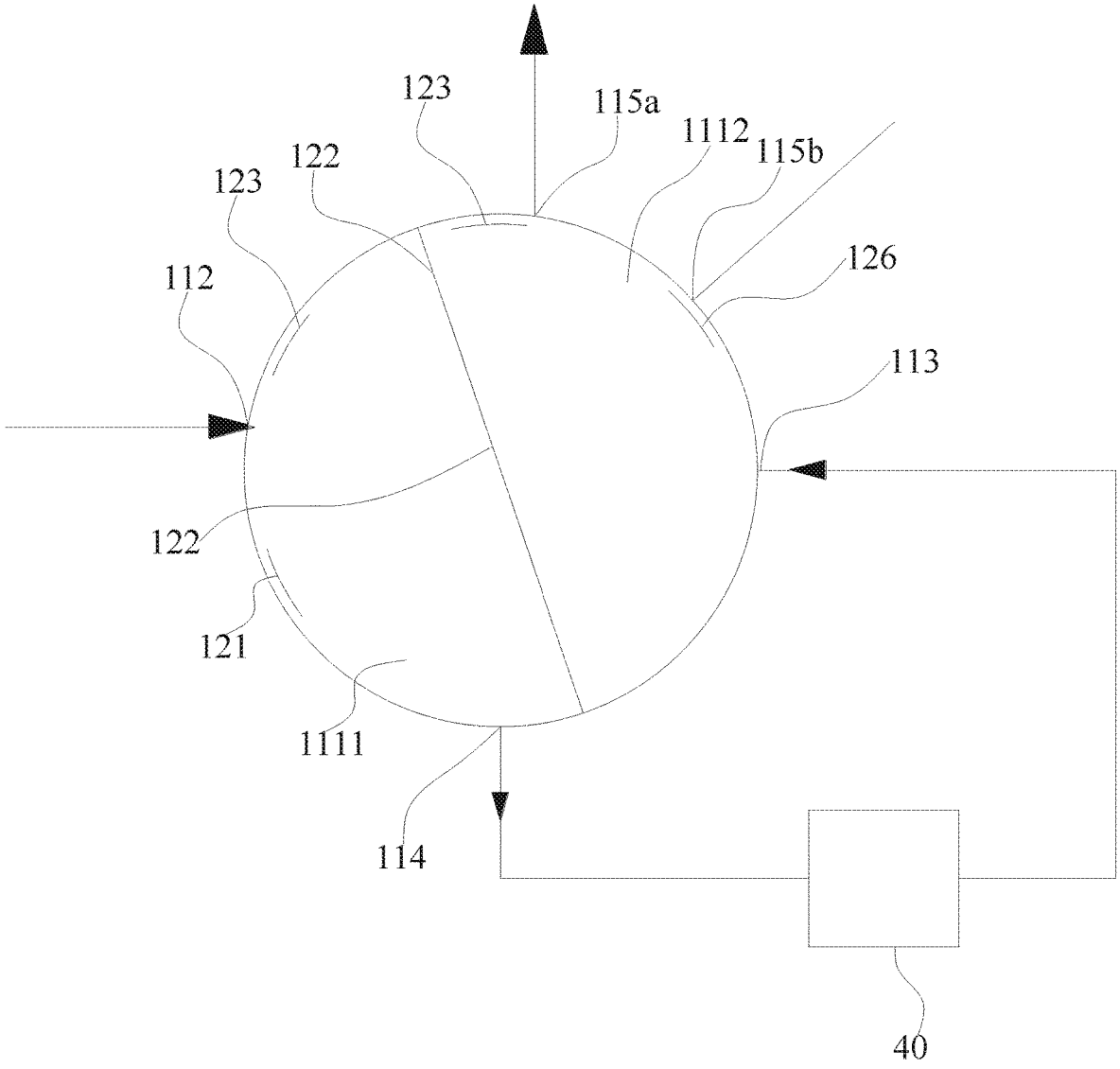
FIG. 3 is a schematic diagram of a diverter valve assembly in a second mode according to an embodiment of the present disclosure.

Referring to FIG. 3, in an example shown in FIG. 3, when the diverter valve 12 rotates to a position shown in FIG. 3, the diverter valve assembly 10 is in a second mode. The first baffle 121 opens the first water outlet 114 as the diverter valve 12 rotates. The first water diversion chamber 1111 is communicated with the water inlet 112 and the first water outlet 114, and the first water outlet 114 is communicated with the heating device 40. The third baffle 126 is offset from the water return port 113 as the diverter valve 12 rotates, and blocks the second water outlet 115*b* of the two second water outlets. The two second baffles 123 are both offset from the second water outlet 115*a* of the two second water outlets.

The second water outlet 115*a* is communicated with the water return port 113, and the second water outlet 115*b* is blocked from the water return port 113. The second water diversion chamber 1112 is communicated with the second water outlet 115*a* and the water return port 113. The water inlet 112 and the first water outlet 114 are located on a side where the first water diversion chamber 1111 is located, while the water return port 113 and the two second water outlets are located on a side where the second water diversion chamber 1112 is located.

At this time, after entering through the water inlet 112, the liquid can flow out from the first water outlet 114 via the first water diversion chamber 1111, subsequently flow back to the second water diversion chamber 1112 through the water return port 113 after being heated by the heating device 40, and flow out from the second water outlet 115*a*. The flow direction of the liquid is shown by arrows in FIG. 3. In this way, the diverter valve assembly 10 is in a mode of supplying water through one second water outlet 115*a* alone. When the diverter valve assembly 10 is applied to the household appliance 200, the second water outlet 115*a* may be communicated with the third spray arm 33, and the second water outlet 115*b* may be communicated with the first spray arm 31 and the second spray arm 32. By switching the opening or closing states of the two second water outlets, the first spray arm 31, the second spray arm 32, and the third spray arm 33 of the household appliance 200 can spray alternately.

In examples shown in FIGS. 12 and 13 (in combination with FIGS. 21 and 22), the diverter valve assembly 10 is in the above second mode. The first water diversion chamber 1111 is communicated with the water inlet 112 and the first water outlet 114 by means of the water through hole 1211 in the first baffle 121, and the first water outlet 114 can be communicated with the heating device 40. A second baffle 123*a* of the two second baffles spaced apart from each other opens the second water outlet 115*a* as the diverter valve 12 rotates, and a second baffle 123*b* of the two second baffle spaced apart from each other closes the second water outlet 115*b* as the diverter valve 12 rotates. The second water outlet 115*b* is blocked from the water return port 113. The second water diversion chamber 1112 is communicated with the second water outlet 115*a* and the water return port 113. The flow direction of liquid in the diverter valve assembly 10 is shown by dotted arrows in FIGS. 12 and 13.

Figure 4:
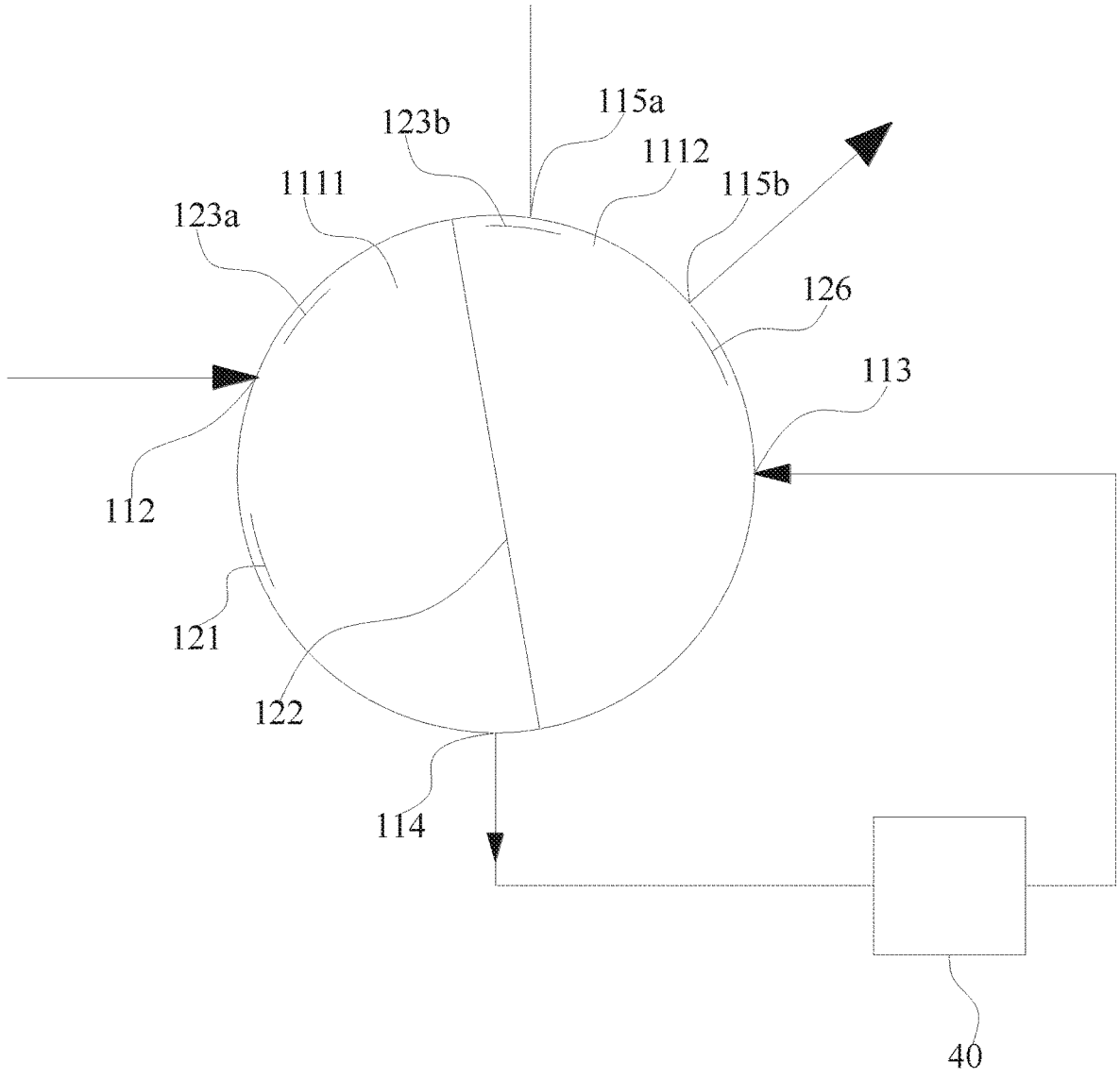
FIG. 4 is a schematic diagram of a diverter valve assembly in a third mode according to an embodiment of the present disclosure.

In an example shown in FIG. 4, when the diverter valve 12 rotates to a position shown in FIG. 4, the diverter valve assembly 10 is in a third mode. The first baffle 121 opens the first water outlet 114 as the diverter valve 12 rotates. The first water diversion chamber 1111 is communicated with the water inlet 112 and the first water outlet 114, and the first water outlet 114 is communicated with the heating device 40. The third baffle 126 rotates to be offset from the water return port 113, so as to open the water return port 113. The second baffle 123*b* of the two second baffles blocks the second water outlet 115*a* of the two second water outlets, as the diverter valve 12 rotates. The second water outlet 115*a* is blocked from the water return port 113. The second baffle 123*a* and the second baffle 123*b* are both offset from the second water outlet 115*b*, so as to open the second water outlet 115*b*. The second water outlet 115*b* is communicated with the water return port 113. The second water diversion chamber 1112 is communicated with the second water outlet 115*b* and the water return port 113. The water inlet 112 and the first water outlet 114 are located on a side where the first water diversion chamber 1111 is located, while the water return port 113 and the two second water outlets are located on a side where the second water diversion chamber 1112 is located.

At this time, after entering through the water inlet 112, the liquid can flow out from the first water outlet 114 via the first water diversion chamber 1111, subsequently flow back to the second water diversion chamber 1112 through the water return port 113 after being heated by the heating device 40, and flow out from the second water outlet 115*b*. The flow direction of the liquid is shown by arrows in FIG. 4. In this way, the diverter valve assembly 10 is in a mode of supplying water through one second water outlet 115*b* alone.

In examples shown in FIGS. 14 to 15 (in combination with FIGS. 21 and 22), the diverter valve assembly 10 is in the above third mode. The first water diversion chamber 1111 is communicated with the water inlet 112 and the first water outlet 114 by means of the water through hole 1211 in the first baffle 121, and the first water outlet 114 can be communicated with the heating device 40. The second baffle 123*a* of the two second baffles spaced apart from each other closes the second water outlet 115*a* as the diverter valve 12 rotates, and the second baffle 123*b* of the two second baffle spaced apart from each other opens the second water outlet 115*b* as the diverter valve 12 rotates. The second water outlet 115*a* is blocked from the water return port 113, and the second water outlet 115*b* is in communication with the water return port 113. The second water diversion chamber 1112 is communicated with the second water outlet 115*b* and the water return port 113. The flow direction of liquid in the diverter valve assembly 10 is shown by dotted arrows in FIGS. 14 and 15.

Figure 5:
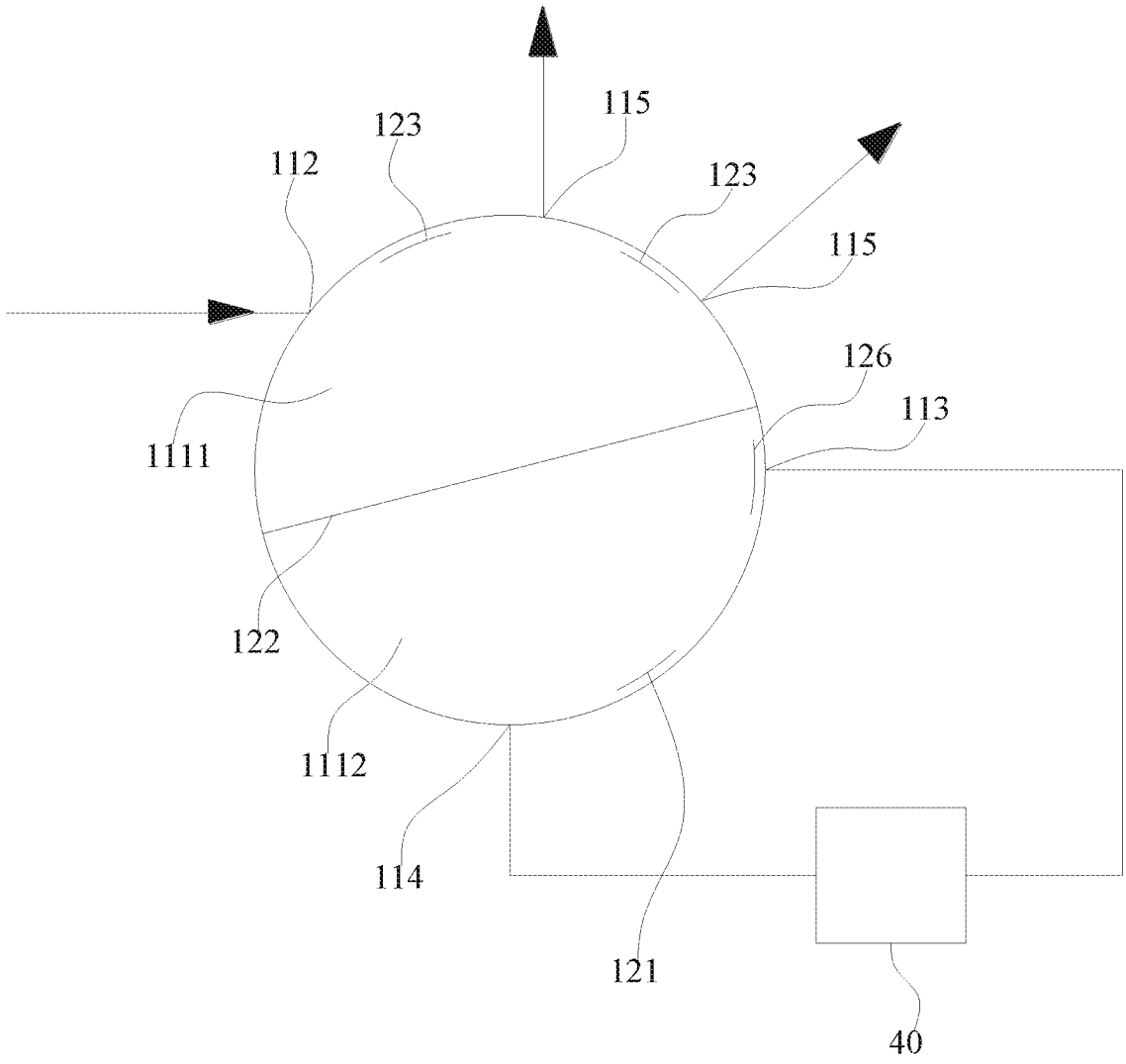
FIG. 5 is a schematic diagram of a diverter valve assembly in a fourth mode according to an embodiment of the present disclosure.

In an example shown in FIG. 5, when the diverter valve 12 rotates to a position shown in FIG. 5, the diverter valve assembly 10 is in a fourth mode. The diverter valve assembly 10 rotates so that the third baffle 126 blocks the water return port 113, and the partition baffle 122 blocks the water inlet 112 and the first water outlet 114. The first water outlet 114 and the water return port 113 are both blocked by the partition baffle 122 from the water inlet 112, such that a flow path between the water inlet 112 with the first water outlet 114 and the heating device 40 is blocked. Moreover, the two second baffles 123 are offset from the two second water outlets 115, to communicate the first water diversion chamber 1111 with the water inlet 112 and the two second water outlets 115. The water inlet 112 and the two second water outlets 115 are located on a side where the first water diversion chamber 1111 is located, and the water return port 113 and the first water outlet 114 are located on a side where the second water diversion chamber 1112 is located.

At this time, after entering through the water inlet 112, the liquid may directly flow out from the two second water outlets 115 via the first water diversion chamber 1111, and will not be heated by the heating device 40. The flow direction of the liquid is shown by arrows in FIG. 5. In such a case, the diverter valve assembly 10 can also supply water through the two second water outlets 115 simultaneously. When the diverter valve assembly 10 is applied to the household appliance 200, one of the two second water outlets 115 can be communicated with the third spray arm 33, and the other one of the two second water outlets 115 can be communicated with the first spray arm 31 and the second spray arm 32; the heating device 40 is bypassed; and the water entering from the water inlet 112 can be directly discharged from the second water outlets 115 without passing through the water return port 113. As a result, when the two second water outlets 115 are opened at the same time, the three spray arms of the household appliance 200 can simultaneously spray water that is not heated by the heating device 40, effectively reducing the flow resistance in the dishwasher during the non-heating period, so as to further reduce the energy consumption of the dishwasher.

In examples shown in FIGS. 16 to 17 (in combination with FIGS. 21 and 22), the diverter valve assembly 10 is in the fourth mode. The diverter valve 12 rotates, so that the water through hole 1211 in the first baffle 121 is not in communication with the water inlet 112 and the first water outlet 114, the partition baffle 122 blocks the water inlet 112 from the first water outlet 114, and the first water outlet 114 and the water return port 113 are both blocked by the partition baffle 122 from the water inlet 112. The two second baffles 123 spaced apart from each other are offset from the two second water outlets 115, so that the first water diversion chamber 1111 is communicated with the water inlet 112 and the two second water outlets 115. The first water diversion chamber 1111 is communicated with the water inlet 112 and the two second water outlets 115. The flow of the liquid in the diverter valve assembly 10 is shown by dotted arrows in FIGS. 16 to 17.

Figure 6:
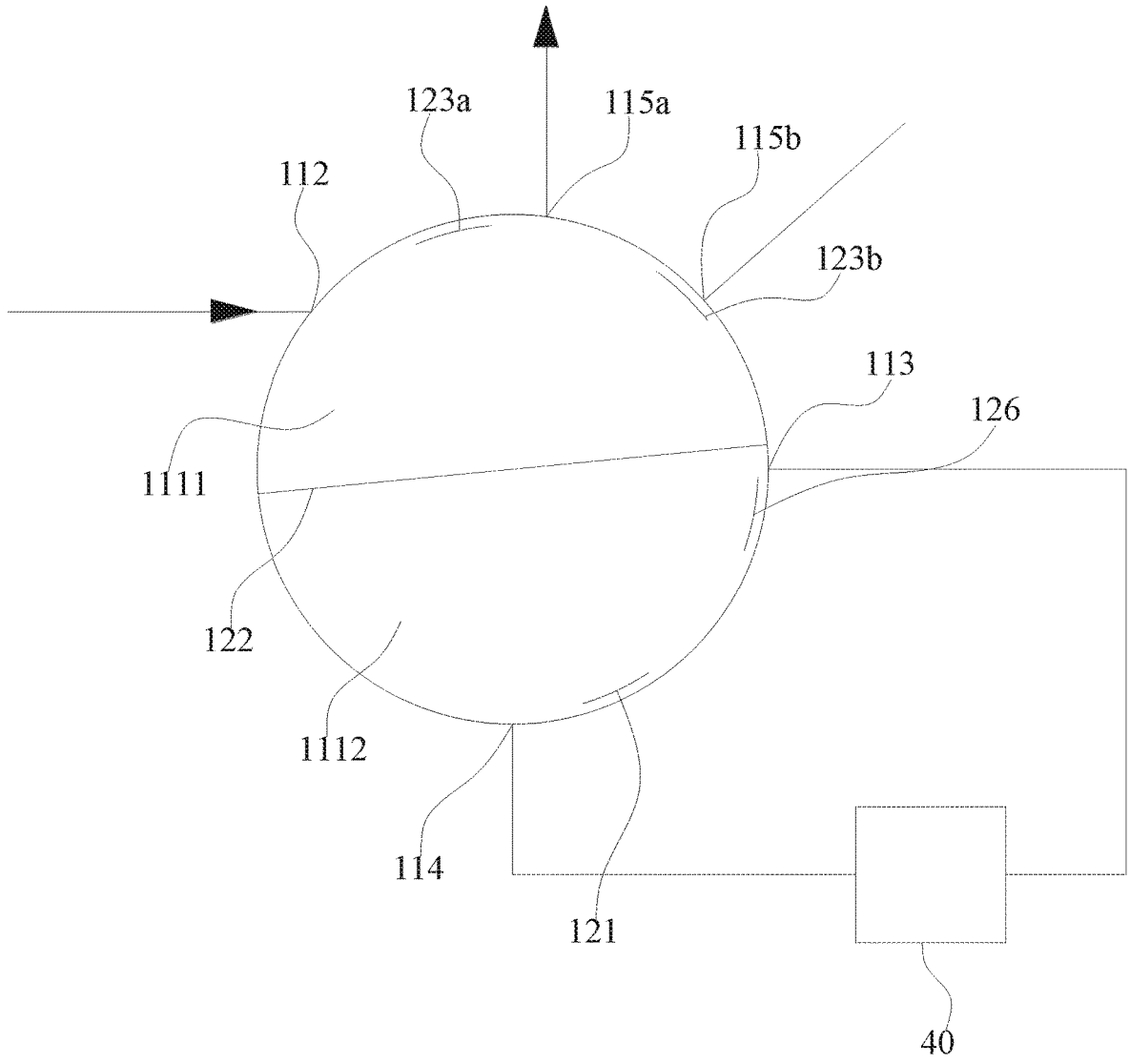
FIG. 6 is a schematic diagram of a diverter valve assembly in a fifth mode according to an embodiment of the present disclosure.

When the diverter valve 12 rotates to a position shown in FIG. 6, the diverter valve assembly 10 is in a fifth mode. The diverter valve assembly 10 rotates, so that the first baffle 121 closes the first water outlet 114, and the partition baffle 122 blocks the water inlet 112 from the first water outlet 114, thereby blocking the flow path between the water inlet 112 with the first water outlet 114 and the heating device 40. In addition, the second baffle 123*b* of the two second baffles blocks the second water outlet 115*b* of the two second water outlets, and the first baffle 123*a* and the second baffle 123*b* are both offset from the second water outlet 115*a* of the two second water outlets, such that the first water diversion chamber 1111 is communicated with the water inlet 112 and the second water outlet 115*a*. The second water outlet 115*b* is blocked by the second baffle 123*b* from the water inlet 112. Due to the partition baffle 122, the first water outlet 114 and the water return port 113 are located on a side of the low-pressure second water diversion chamber 1112, and the water inlet 112 and the two second water outlets are located on a side of the high-pressure first water diversion chamber 1111. In this way, the flow path between the water inlet 112 with the first water outlet 114 and the heating device 40 can be completely blocked.

At this time, after entering through the water inlet 112, the liquid can directly flow out from the second water outlet 115*b* via the first water diversion chamber 1111, and will not be heated by the heating device 40. The flow direction of the liquid is shown by arrows in FIG. 6. In such a case, the diverter valve assembly 10 is in a mode of supplying water through one second water outlet 115*b* alone. When the diverter valve assembly 10 is applied to the household appliance 200, the second water outlet 115*a* can be communicated with the third spray arm 33, and the second water outlet 115*b* can be communicated with the first spray arm 31 and the second spray arm 32; the heating device 40 is bypassed; the water entering from the water inlet 112 can be directly discharged from the second water outlet 115*a* without passing through the water return port 113. By switching the opening or closing states of the two second water outlets, the first spray arm 31, the second spray arm 32, and the third spray arm 33 of the household appliance 200 can alternately spray water that is not heated by the heating device 40, effectively reducing the flow resistance in the dishwasher during the non-heating period, so as to further reduce the energy consumption of the dishwasher. In examples shown in FIGS. 18 to 19 (in combination with FIGS. 21 and 22), the diverter valve assembly 10 is in the above fifth mode. The diverter valve 12 rotates, so that the water through hole 1211 in the first baffle 121 is not in communication with the water inlet 112 and the first water outlet 114, the partition baffle 122 blocks the water inlet 112 from the first water outlet 114, and the first water outlet 114 and the water return port 113 are both blocked by the partition baffle 122 from the water inlet 112. The second baffle 123*b* of the two second baffles spaced apart from each other closes the second water outlet 115*b* of the two second water outlets, to block the second water outlet 115*b* from the first water diversion chamber 1111; the second baffle 123*a* of the two second baffles opens the second water outlet 115*a* of the two second water outlets, to communicate the second water outlet 115*a* with the first water diversion chamber 1111 and the water inlet 112. The flow of the liquid in the diverter valve assembly 10 is shown by dotted arrows in FIGS. 18 to 19.

When the diverter valve 12 rotates to a position shown in FIG. 7, the diverter valve assembly 10 is in a sixth mode. The diverter valve assembly 10 rotates, so that the first baffle 121 closes the first water outlet 114, the partition baffle 122 blocks the water inlet 112 from the first water outlet 114, and hence the flow path between the water inlet 112 with the first water outlet 114 and the heating device 40 is blocked. In addition, the second baffle 123*a* of the two second baffles blocks the second water outlet 115*a* of the two second water outlets. The first baffle 123*a* and the second baffle 123*b* are both offset from the second water outlet 115*b* of the two second water outlets, such that the first water diversion chamber 1111 is communicated with the water inlet 112 and the second water outlet 115*b*. The second water outlet 115*a* is blocked by the second baffle 123*a* from the water inlet 112. Since the first baffle 121 blocks the first water outlet 114, even if the water return port 113 is on the side of the high-pressure first water diversion chamber 111, the liquid flowing out from the water inlet 112 will not pass through the heating device 40.

At this time, after entering through the water inlet 112, the liquid can directly flow out from the second water outlet 115*a* via the first water diversion chamber 1111, and will not be heated by the heating device 40. The flow direction of the liquid is shown by arrows in FIG. 7. In this way, the diverter valve assembly 10 is in a mode of supplying water through one second water outlet 115*a* alone.

It could be understood that in a case of three second water outlets and three second baffles, when the household appliance 200 needs to use the heating device 40 (that is, a heating mode), it is possible to communicate one of the three second water outlets of the diverter valve assembly 10 with one corresponding spray arm of the household appliance 200, or communicate two of the three second water outlets with two corresponding spray arms of the household appliance 200, or communicate the three second water outlets with three corresponding spray arms of the household appliance 200. That is, in the heating mode, the diverter valve assembly 10 can realize the switching of seven different modes.

When the household appliance 200 does not need to use the heating device 40 (that is, in a non-heating mode), it is possible to communicate one of the three second water outlets of the diverter valve assembly 10 with one corresponding spray arm of the household appliance 200, or communicate two of the three second water outlets with two corresponding spray arms of the household appliance 200, or communicate the three second water outlets with three corresponding spray arms of the household appliance 200. That is, in the non-heating mode, the diverter valve assembly 10 can also realize the switching of seven different modes. In some embodiments, the diverter valve 12 includes the fixing portion 124. The second baffle 123 is detachably mounted to the fixing portion 124, which facilitates the mounting and detachment of the second baffle 123. In this embodiment, the partition baffle 122 is fixedly connected to the fixing portion 124. For example, the partition baffle 122 and the fixing portion 124 are of an integral structure. The partition baffle 122 and the second baffle 123 are located on both sides of the fixing portion 124. When the diverter valve 12 rotates, the partition baffle 122 and the fixing portion 124 rotate along the circumferential direction of the water diversion chamber 111, and the first water diversion chamber 1111 and the second water diversion chamber 1112 vary as the partition baffle 122 rotates. The second baffle 123 rotates along with the fixing portion 124 to open or close the second water outlet 115. In an example shown in FIG. 12, under the action of water pressure, the second baffle 123 can be pressurized to seal the second water outlet 115. Certainly, it could be understood that in other examples, the second baffle plate can seal the second water outlet under the action of gravity, and can be pressurized to open the second water outlet.

In some embodiments, the housing 11 is provided with a channel 13 (see FIG. 11). The channel 13 is communicated with the second water outlet 115. The second baffle 123 includes a bottom plate 1231 and a first fitting portion 1232 extending upwards from the bottom plate 1231 (see FIG. 21). The fixing portion 124 is formed with a second fitting portion 1241 that is fitted with the first fitting portion 1232. The second baffle 123 can open or close an entrance 131 of the channel 13 through the bottom plate 1231 when the diverter valve 12 rotates, so as to open or close the second water outlet 115.

In an example shown in FIG. 20, the first fitting portion 1232 can be a tab extending upwards from the bottom plate 1231. The second fitting portion 1241 is a through slot formed in a side portion of the fixing portion 124. The tab can pass through the through slot, so that the first fitting portion 1232 is detachably mounted to the second fitting portion 1241. Moreover, the tab can move up and down in the through slot.

In examples shown in FIGS. 20 and 21, the diverter valve 12 has a substantially cylindrical shape overall. The fixing portion 124 exhibits a ring shape. Two second baffles 123 are provided. The two second baffles 123 are mounted to the fixing portion 124 and spaced apart from each other, and can move in the circumferential direction of the water diversion chamber 111 along with the fixing portion 124. In addition, the bottom plate 1231 has a substantially fan shape. A sealing surface 1233 is formed on a side of the bottom plate 1231 away from the first fitting portion 1232. Under the action of water pressure, the bottom plate 1231 is pressurized, and the entrance 131 of the channel 13 can be sealed by the sealing surface 1233, such that the second water outlet 115 is sealed.

In some embodiments, the diverter valve assembly 10 includes a driving mechanism 14. The driving mechanism 14 is connected to the diverter valve 12. The driving mechanism is used to drive the diverter valve 12 to rotate.

For example, the driving mechanism 14 includes a driving portion 141 and a transmission portion 15. The transmission portion 15 connects the driving portion 141 and the diverter valve 12. The driving portion 141 is used to drive the transmission portion 15 to rotate, so as to drive the diverter valve 12 to rotate. The transmission portion 15 can be configured according to specific situations, and for example, a gear meshing transmission manner, a belt transmission manner, or a coupler transmission manner may be adopted.

In some embodiments, the diverter valve assembly 10 includes a sensor 16. The transmission portion 15 includes a transmission member 151, and the sensor 16 is used to detect a position of the transmission member 151. In this way, a rotation state of the diverter valve 12 can be determined according to the position of the transmission member 151 detected by the sensor 16, and then the rotation of the diverter valve 12 can be controlled by means of the transmission member 151, so that the switching among different communication states of the diverter valve assembly 10 can be realized accurately by controlling the rotation of the diverter valve 12. The transmission member 151 may be a transmission gear, for example.

In some embodiments, the driving portion 141 includes an electric motor 142. The diverter valve 12 includes a driving rod 125. The driving rod 125 extends downwards from the top of the diverter valve 12. The diverter valve 12 is connected to the transmission member 151 through the driving rod 125.

In this embodiment, the driving rod 125 extends downwards from the partition baffle 122. The fixing portion 124 surrounds the driving rod 125. The diverter valve 12 is connected to the transmission member 151 through the driving rod 125. The driving rod 125 may be connected to the transmission member 151 in a snapping manner. The electric motor 142 is used to drive the transmission member 151 to rotate, so as to drive the driving rod 125 to rotate.

In this embodiment, the first baffle 121, the driving rod 125, the partition baffle 122, and the fixing portion 124 are of an integral structure, which is convenient for processing and enhances the overall stability of the diverter valve 12.

It could be understood that, to improve the operational stability of the driving portion 141 and the transmission portion 15, a fixing cover plate 19 may be provided, the electric motor 142 and the transmission member 151 are disposed on opposite sides of the fixing cover plate 19, and a rotating shaft of the electric motor 142 passes through the fixing cover plate 19 and is connected to the transmission member 151.

In some embodiments, the housing 11 includes a lower housing 17 and an upper housing 18. The lower housing 17 is connected to the upper housing 18. The connection manner of the lower housing 17 and the upper housing 18 can be set according to specific situations.

In some embodiments, the lower housing 17 is provided with the water inlet 112, the water return port 113 and the second water outlet 115; the upper housing 18 is provided with the first water outlet 114.

In this embodiment, the lower housing 17 defines the water diversion chamber 111 therein. An upper end of the water diversion chamber 111 is open. The lower housing 17 is provided with the water inlet 112, the water return port 113, and the second water outlet 115. The upper housing 18 is disposed on an upper end of the lower housing 17 and closes the water diversion chamber 111. The upper housing 18 is provided with the first water outlet 114. The upper housing 18 can be detachably mounted on the upper end of the lower housing 17, and the water inlet 112, the water return port 113 and the second water outlet 115 can be provided in a side wall or a bottom wall or a top wall of the lower housing 11, which can be set according to specific situations.

In examples shown in FIGS. 8 and 19, the lower housing 17 is substantially columnar. The side wall of the lower housing 17 is formed with a water inlet pipe 171 and a water return pipe 172. The top wall of the lower housing 17 is formed with a first water outlet pipe 173. The bottom wall of the lower housing 17 is formed with a second water outlet pipe 174. The water inlet pipe 171 and the water return pipe 172 extend outwards from the side wall of the lower housing 17. The first water outlet pipe 173 extends outwards from the top wall of the lower housing 17. The second water outlet pipe 174 extends outwards from the bottom wall of the lower housing 17. The water inlet pipe 171 is provided with the water inlet 112. The water return pipe 172 is provided with the water return port 113. The first water outlet pipe 173 is provided with the first water outlet 114. The second water outlet pipe 174 is provided with the second water outlet 115.

A dishwasher 100 according to embodiments of the present disclosure will be described below with reference to FIGS. 23-28. As shown in FIGS. 23-28, the dishwasher 100 according to the embodiments of the present disclosure includes: a washing inner container 1, a spray arm, a heating device 3, and a diverter valve 4.

The washing inner container 1 is provided with a washing outlet 111. The spray arm is disposed in the washing inner container 1, and the spray arm is provided with a spray inlet. The heating device 3 has a to-be-heated water inlet 321 and a heated water outlet 322, and the heating device 3 is used to heat washing water. The diverter valve 4 is provided with a water inlet 41, a second water outlet, a first water outlet 43, and a water return port 44. The water inlet 41 is connected to the washing outlet 111. The second water outlet is connected to the spray inlet. The first water outlet 43 is connected to the to-be-heated water inlet 321. The water return port 44 is connected to the heated water outlet 322.

For example, the washing inner container 1 defines a washing chamber therein. A bracket may be provided in the washing chamber and used to support tableware. The spray arm is disposed in the washing inner container 1 and is provided with the spray inlet. The washing water enters the spray arm through the spray inlet, and subsequently is sprayed to the tableware through a nozzle provided in the spray arm, thereby cleaning the tableware.

Optionally, the washing water sprayed on the tableware may be collected in a water sump 11 disposed at the bottom of the washing inner container 1, and the washing outlet 111 is formed in the bottom of the water sump 11, such that the washing water flows out from the washing outlet 111.

A washing water circulation system further includes a washing pump 5. The washing pump 5 has an inlet in communication with the washing outlet 111 and an outlet in communication with the spray inlet, and the washing pump 5 offers power to the circulation of the washing water.

In the embodiments of the present disclosure, the dishwasher 100 includes at least two working modes. In a first mode, the water inlet 41 of the diverter valve 4 is communicated with the second water outlet. In a second mode, the water inlet 41 of the diverter valve 4 is communicated with the first water outlet 43, and the water return port 44 is communicated with the second water outlet.

In other words, when the water inlet 41 of the diverter valve 4 is communicated with the second water outlet, under the drive of the washing pump 5, the washing water flows out from the washing outlet 111, subsequently flows towards the spray inlet via the water inlet 41 and the second water outlet in sequence, and flows into the spray arm from the spray inlet to be sprayed. Thus, in the first mode, the washing water does not flow through the heating device 3, and the washing water will not be heated. Hence, the first mode may be called a non-heating mode. In the first mode, the heating device 3 can be turned off, thereby saving energy. Certainly, the heating device may also be turned on as needed, and be used to heat other apparatuses, spaces, or the like. For example, the heating device can be turned on to dry the inner space of the washing inner container 1.

In addition, when the water inlet 41 of the diverter valve 4 is communicated with the first water outlet 43, and the water return port 44 is communicated with the second water outlet, under the drive of the washing pump 5, the washing water flows out from the washing outlet 111, subsequently flows towards the to-be-heated water inlet 321 of the heating device 3 via the water inlet 41 and the first water outlet 43 in sequence, and flows into the heating device 3 from the to-be-heated water inlet 321. The washing water is heated to high-temperature washing water, subsequently flows out from the heated water outlet 322, and flows towards the spray inlet via the water return port 44 and the second water outlet in sequence. The high-temperature washing water flows into the spray arm from the spray inlet to be sprayed. Thus, in the second mode, the washing water flows through the heating device 3, and at this time, the heating device 3 can be started to heat the washing water to increase the temperature of the washing water, so that the dishwasher 100 operates in a high-temperature washing mode, which can improve the washing effect. The second mode may be called a heating mode.

For the dishwasher 100 according to the embodiments of the present disclosure, by providing the diverter valve 4, the washing water can be diverted in different washing modes. In the non-heating mode, the washing water does not flow through the heating device 3, which can reduce the flow resistance in the water flow system during the non-heating period to a certain extent, speed up the water flow, improve the cleaning speed and cleanliness, and upgrade the system washing performance. Moreover, in the non-heating mode, the turn-on or turn-off of the heating device 3 and the flow path of the washing water can be independently controlled, so that the use of the dishwasher 100 becomes more convenient. In addition, the water diversion function is integrated in one diverter valve 4, so that the water diversion structure is compact, the pipeline is shortened, and the control method is simple.

In some embodiments of the present disclosure, the heating device 3 includes a compressor 31, a condenser 32, a throttling device 33, and an evaporator 34 that are sequentially connected end to end, so as to constitute a refrigerant cycle. That is to say, according to some embodiments of the present disclosure, the dishwasher 100 is a heat pump dishwasher, and a refrigerant undergoes processes of compression, condensation and heat release, throttling expansion, evaporation and heat absorption in a heat pump system. After converting low-grade energy into high-grade thermal energy, the refrigerant is released into the washing water to achieve a purpose of efficient heating with low energy consumption. Compared with the traditional electric heating, the performance coefficient of the heating system using the heat pump is three to four times or even more times higher than the conventional electric heating systems. The dishwasher 100 adopting the heat pump heating technology has a significant energy-saving effect and can greatly reduce the energy consumption, which is an effective means to reduce the energy consumption of the dishwasher 100.

Further, the condenser 32 defines a first liquid flow channel and a second liquid flow channel therein. Two ends of the first liquid flow channel are provided with the to-be-heated water inlet 321 and the heated water outlet 322, respectively. Two ends of the second liquid flow channel are communicated with the compressor 31 and the throttling device 33, respectively. In other words, the condenser 32 is a liquid-to-liquid heat exchanger, thereby improving the heating efficiency of condensate water.

Moreover, in order to improve the heat exchange efficiency of the washing water and the refrigerant, the first liquid flow channel and the second liquid flow channel may be designed complicatedly, to increase the flow resistance in the first liquid flow channel Thus, if the condenser 32 is directly connected to the original washing system flow path, there may be problems that the spray pressure of the spray arm of the dishwasher 100 drops or the power consumption of the washing pump 5 increases, especially during the non-heating period. For this reason, in the dishwasher 100 according to the embodiments of the present disclosure, by providing the diverter valve 4, the problem of large flow resistance caused by the washing water flowing through the condenser 32 during the non-heating period can be solved.

It should be noted that in the heating mode, the above heat pump system is turned on, and the washing water flowing out of the washing inner container 1 can be heated by the condenser, and the high-temperature washing water enters the spray arm to wash the tableware in the washing inner container 1 at high temperature, thereby improving the washing effect.

In the non-heating mode, the above heat pump system can be turned off, which can save energy. Certainly, the above heat pump system can also be turned on as needed and be used to heat or cool other apparatuses, spaces, or the like. For example, the heat pump system can be turned on, to utilize the condenser 32 to heat and dry the inner space of the washing inner container 1 or utilize the evaporator 34 to cool and dehumidify the inner space of the washing inner container 1.

Certainly, the present disclosure is not limited thereto. The heating device 3 according to the embodiments of the present disclosure may also adopt electric heating. For example, electric heating wires or the thick film heating technology may be used to heat the circulating water. Electric heating is used to heat the washing water, the structure is simple, and the control is simple.

The heating device 3 will be exemplified as a heat pump system below for detailed description.

In some embodiments of the present disclosure, there may be a plurality of spray arms and one second water outlet. The spray inlet of each spray arm is communicated with the second water outlet, so that the washing water can be dispersed into the plurality of spray arms to be sprayed, after flowing out from the second water outlet, and hence the cleaning effect is better.

In other embodiments of the present disclosure, there may be a plurality of spray arms and a plurality of second water outlets. Each second water outlet is communicated with the spray inlet of at least one spray arm. Thus, the plurality of second water outlets and the plurality of spray arms can be combined in various ways, thereby realizing connection structures for different requirements, and achieving alternate cleaning of the spray arms.

For example, there are the plurality of spray arms and the plurality of second water outlets. Each second water outlet is communicated with the spray inlet of at least one spray arm. In the first mode, the water inlet 41 is selectively communicated with at least one second water outlet, so that in the non-heating mode, the washing water can flow into one or more spray arms as needed, thereby achieving the alternate cleaning mode.

Similarly, there are the plurality of spray arms and the plurality of second water outlets. Each second water outlet is communicated with the spray inlet of at least one spray arm. In the second mode, the water return port 44 is selectively communicated with at least one second water outlet, so that in the heating mode, the washing water can flow into one or more spray arms as needed, thereby achieving the alternate cleaning mode.

It should be noted that the number of spray arms and the number of second water outlets may be equal or unequal, so that the spray arms and second water outlets can be combined as needed. Therefore, in different modes, the washing water can enter a corresponding spray arm through the second water outlet for spray cleaning. The cleaning mode is diversified, and the use of the dishwasher 100 becomes more convenient. The connection manner of the spray arm and the second water outlet, as well as the control of the diverter valve in the case of the corresponding connection manner of the spray arm and the second water outlet will be described below with reference to FIGS. 23-28.

For example, the dishwasher 100 according to an embodiment of the present disclosure will be described below with reference to FIGS. 23-28.

The spray arm includes: a lower spray arm 23, an upper spray arm 21, and a middle spray arm 22. The lower spray arm 23 is disposed at a lower part inside the washing inner container 1, the upper spray arm 21 is disposed at an upper part inside the washing inner container 1, and the middle spray arm 22 is disposed at a middle part inside the washing inner container 1. Thus, by providing the spray arms in the upper, middle, and lower parts of the washing inner container 1, communication among the upper, middle, and lower parts of the washing inner container 1 can be achieved. In this way, during the cleaning process, the lower spray arm 23 can spray water alone; the upper spray arm 21 and the middle spray arm 22 can spray water simultaneously; or the upper spray arm 21, the middle spray arm 22 and the lower spray arm 23 can spray water simultaneously, thereby achieving an alternate spraying effect.

Two second water outlets are provided, and each second water outlet is connected to at least one spray arm. For example, one of the second water outlets is connected to the lower spray arm 23, and the other one thereof is connected to the upper spray arm 21 and the middle spray arm 22 at the same time.

Further, in the first mode, the water inlet 41 is communicated with one of the second water outlets, or the water inlet 41 is communicated with the other one of the second water outlets, or the water inlet 41 is simultaneously communicated with both of the second water outlets. Therefore, in the first mode, when the water inlet 41 is communicated with one of the second water outlets, the washing water can enter the corresponding spray arm through this second water outlet; when the water inlet 41 is communicated with the other one of the second water outlets, the washing water can enter the other corresponding spray arm through the other second water outlet; when the water inlet 41 is simultaneously communicated with both of the second water outlets, the washing water can enter all the spray arms. Therefore, according to different needs, by communicating the water inlet 41 with different second water outlets, alternate cleaning in the non-heating mode can be realized.

That is, in the non-heating mode, the washing water does not flow through the heating device 3 (the condenser 32), and the alternate cleaning sequence is solved in the diverter valve 4, and three non-heating modes are realized: the upper spray arm 21 and the middle spray arm 22 work; the lower spray arm 23 works; the upper spray arm 21, the middle spray arm 22, and the lower spray arm 23 work simultaneously. Therefore, in the non-heating mode, the loss due to the flow resistance caused by flowing through the heating device 3 (the condenser 32) in the washing cycle can be avoided, and hence the pressure of the spray arms and the washing effect will not be affected.

In the second mode, the water return port 44 is communicated with one of the second water outlets, or the water inlet 41 is communicated with the other one of the second water outlets, or the water inlet 41 is simultaneously communicated with both of the second water outlets. Therefore, in the second mode, when the water return port 44 is communicated with one of the second water outlets, the high-temperature washing water can enter the corresponding spray arm through this second water outlet; when the water return port 44 is communicated with the other one of the second water outlets, the high-temperature washing water can enter the other corresponding spray arm through the other second water outlet; when the water return port 44 is simultaneously communicated with both of the second water outlets, the high-temperature washing water can enter all the spray arms. Therefore, according to different needs, by communicating the water return port 44 with different second water outlets, alternate cleaning in the heating mode can be realized.

That is, in the heating mode, the washing water flows through the heating device 3 (the condenser 32), and the flow path is switched in the diverter valve 4. The circulating washing water flows back to the diverter valve 4 after being heated by the heating device 3 (the condenser 32), and three heating modes are realized: the upper spray arm 21 and the middle spray arm 22 work; the lower spray arm 23 works; the upper spray arm 21, the middle spray arm 22, and the lower spray arm 23 work simultaneously. Therefore, it is possible to achieve alternate washing during the entire time sequence in the heating process.

The embodiment will be described in detail below with reference to different examples of FIGS. 23-28.

As shown in FIGS. 23-28, the dishwasher 100 according to the embodiment of the present disclosure includes: a washing inner container 1, a washing pump 5, an upper spray arm 21, a middle spray arm 22, a lower spray arm 23, a heating device 3, and a diverter valve 4. A water sump 11 is provided in a bottom wall of the washing inner container 1.

The heating device 3 includes a compressor 31, a throttling device 33, a condenser 32, and an evaporator 34. Further, the compressor 31, the condenser 32, the throttling device 33, and the evaporator 34 are sequentially connected through pipelines and constitute a closed circulation system, and a refrigerant circulates in the closed pipeline system.

The diverter valve 4 may include a valve body casing, a valve sheet, an electric motor, and a valve sheet transmission mechanism. The valve body casing is provided with a water inlet 41, a second water outlet, a first water outlet 43, and a water return port 44. Two second water outlets are provided, that is, a second water outlet 42*a* located on the left and a second water outlet 42*b* located on the right in FIGS. 23-28.

Further, the washing pump 5 is connected by a pipeline, and the washing pump 5 has an inlet in communication with the water sump 11 and an outlet in communication with the water inlet 41 of the diverter valve 4.

Further, the upper spray arm 21 and the middle spray arm 22 are disposed in the inner container, and spray inlets of the two spray arms converge into one path. A spray inlet 211 of the upper spray arm 21 and a spray inlet 221 of the middle spray arm 22 are connected by a pipeline, and subsequently communicated with the second water outlet of the diverter valve 4 (for example, the second water outlet 42*b* on the right in FIGS. 23-28).

Further, the lower spray arm 23 is disposed in the inner container, and a spray inlet 231 of the lower spray arm 23 is communicated with the other second water outlet (for example, the second water outlet 42*a* on the left in FIGS. 23-28) of the diverter valve 4 through pipeline connection.

Further, a to-be-heated water inlet 321 of the condenser 32 of the heating device 3 is communicated with the first water outlet 43 of the diverter valve 4 through a pipeline, and a heated water outlet 322 is communicated with the water return port 44 of the diverter valve 4 through a pipeline.

In the above flow path connection situation, the washing pump 5 can continuously circulate the washing water in the water sump 11 to the condenser 32 and various spray arms, so as to achieve the purpose of washing the tableware. Through a control program, a rotation angle of the valve sheet of the diverter valve 4 can be controlled to realize the following six modes.

Figure 23:
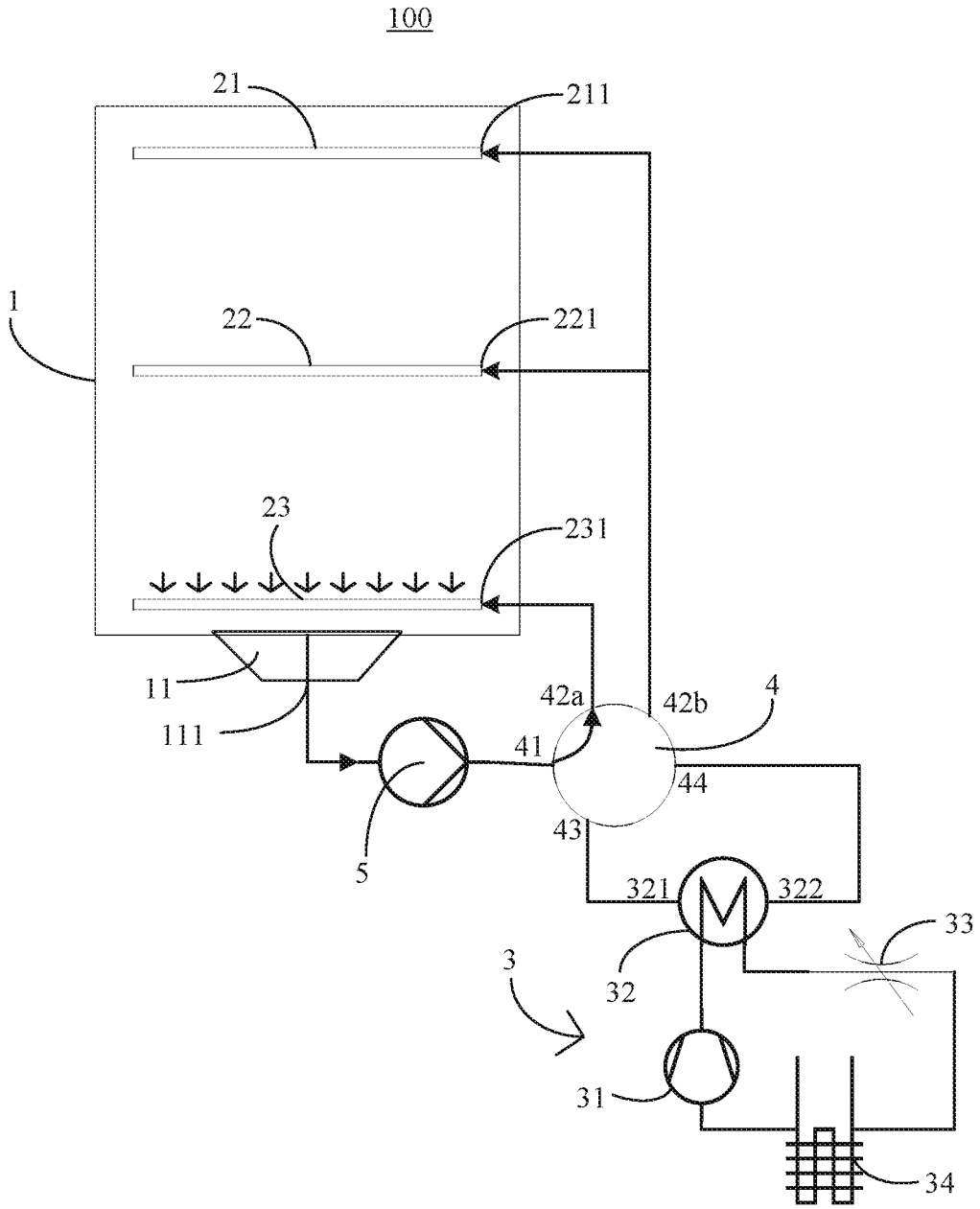
FIG. 23 is a systematic schematic diagram of a dishwasher in a first spray cleaning mode according to the present disclosure.

As shown in FIG. 23, when the valve sheet communicates the water inlet 41 with the second water outlet 42*a* on the left, and blocks the first water outlet 43, the water return port 44, and the second water outlet 42*b* on the right, clean water delivered by the washing pump 5 is directly sent to the lower spray arm 23, so that the dishwasher 100 realizes a spray cleaning mode of the lower spray arm 23 in a non-heating situation.

Figure 24:
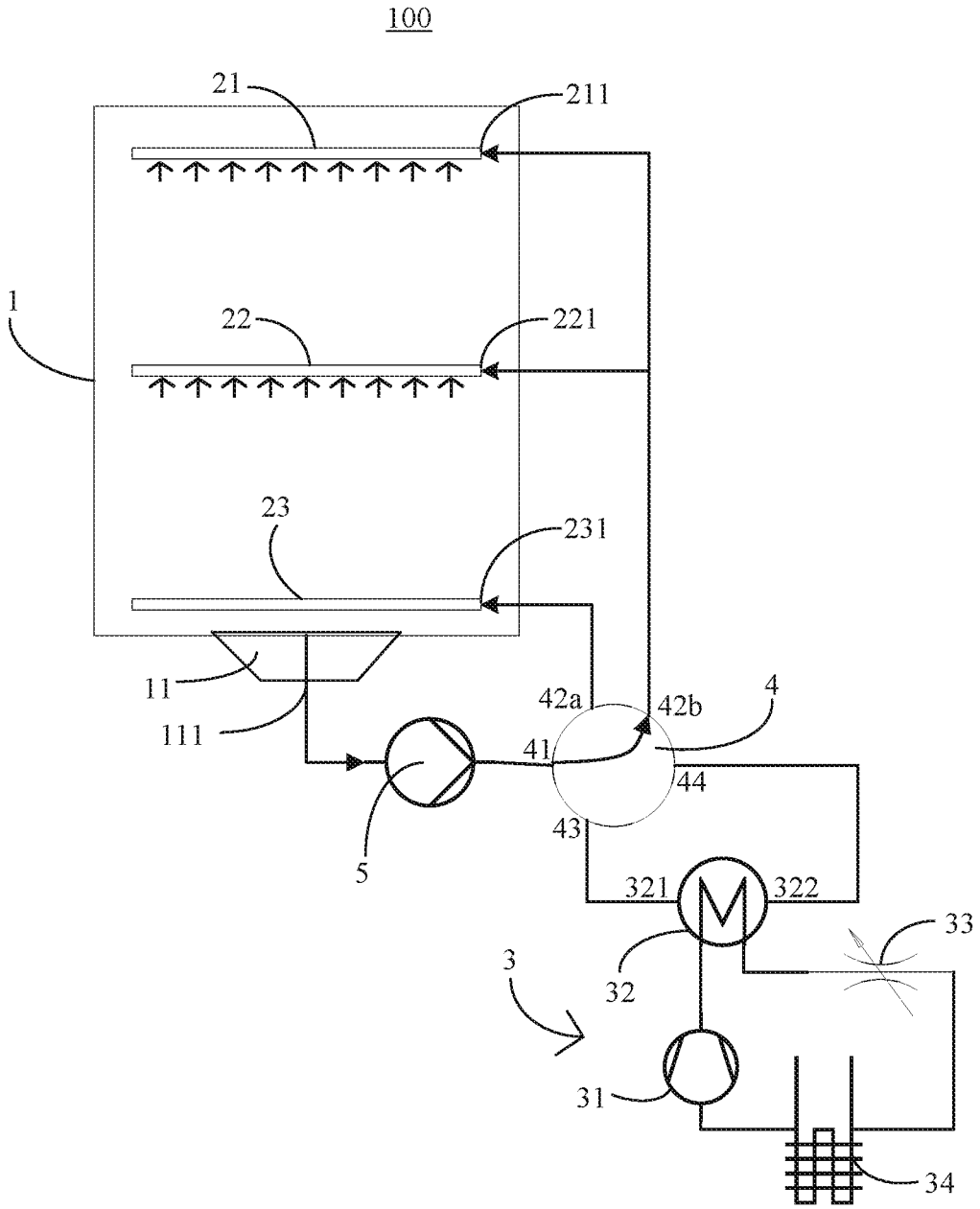
FIG. 24 is a systematic schematic diagram of a dishwasher in a second spray cleaning mode according to the present disclosure.

As shown in FIG. 24, when the valve sheet communicates the water inlet 41 with the second water outlet 42*b* on the right, and blocks the first water outlet 43, the water return port 44, and the second water outlet 42*a* on the left, clean water delivered by the washing pump 5 is sent to the upper spray arm 21 and the middle spray arm 22 simultaneously, so that the dishwasher 100 realizes a simultaneous spray cleaning mode of the upper spray arm 21 and the middle spray arm 22 in a non-heating situation.

Figure 25:
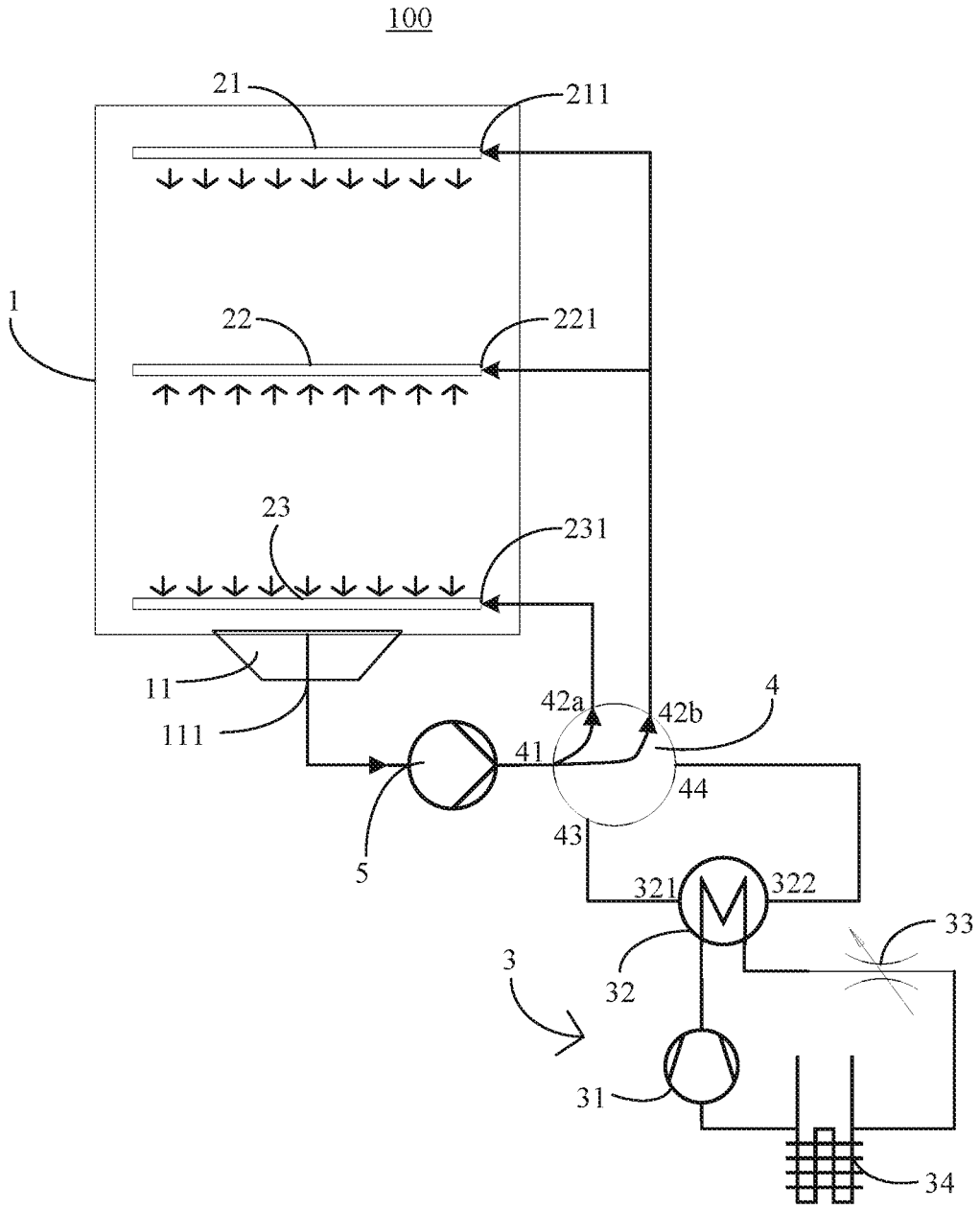
FIG. 25 is a systematic schematic diagram of a dishwasher in a third spray cleaning mode according to the present disclosure.

As shown in FIG. 25, when the valve sheet communicates the water inlet 41 with the second water outlet 42*a* on the left and the second water outlet 42*b* on the right, and blocks the first water outlet 43 and the water return port 44, clean water delivered by the washing pump 5 is sent to the upper spray arm 21, the middle spray arm 22, and the lower spray arm 23 simultaneously, so that the dishwasher 100 realizes a simultaneous spray cleaning mode of the upper spray arm 21, the middle spray arm 22, and the lower spray arm 23 in a non-heating situation.

Further, when the valve sheet communicates the water inlet 41 with the water return port 44, the dishwasher 100 enters a heating mode of the condenser 32. In such a case, communication channels of the water inlet 41 and the water return port 44 are blocked from communication channels of other interfaces.

Figure 26:
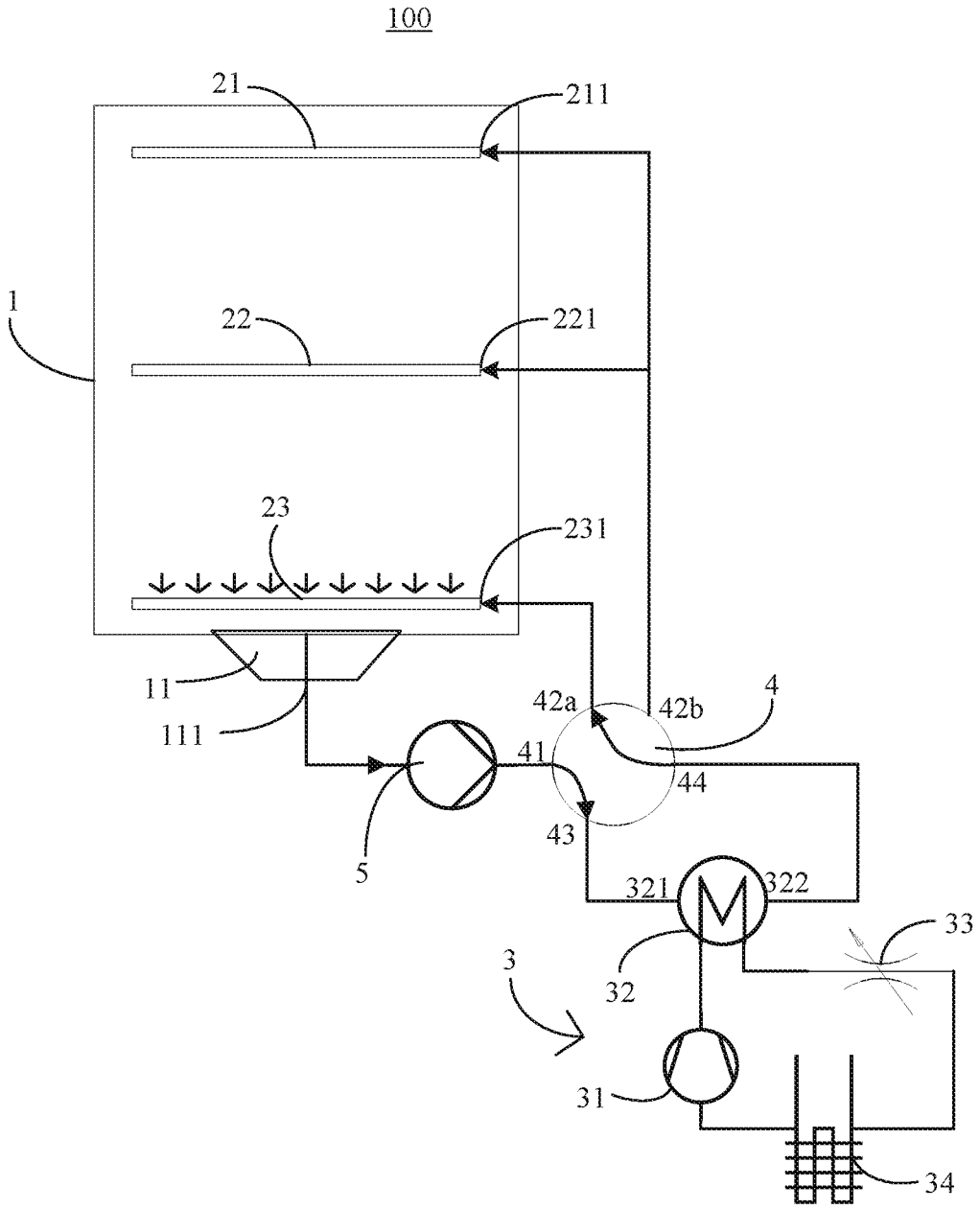
FIG. 26 is a systematic schematic diagram of a dishwasher in a fourth spray cleaning mode according to the present disclosure.

As shown in FIG. 26, in a heating mode, the valve sheet communicates the water inlet 41 with the first water outlet 43 and communicates the water return port 44 with the second water outlet 42*a* on the left, and blocks the second water outlet 42*b* on the right, so that the dishwasher 100 can realize a spray cleaning mode of the lower spray arm 23 in the heating situation.

Figure 27:
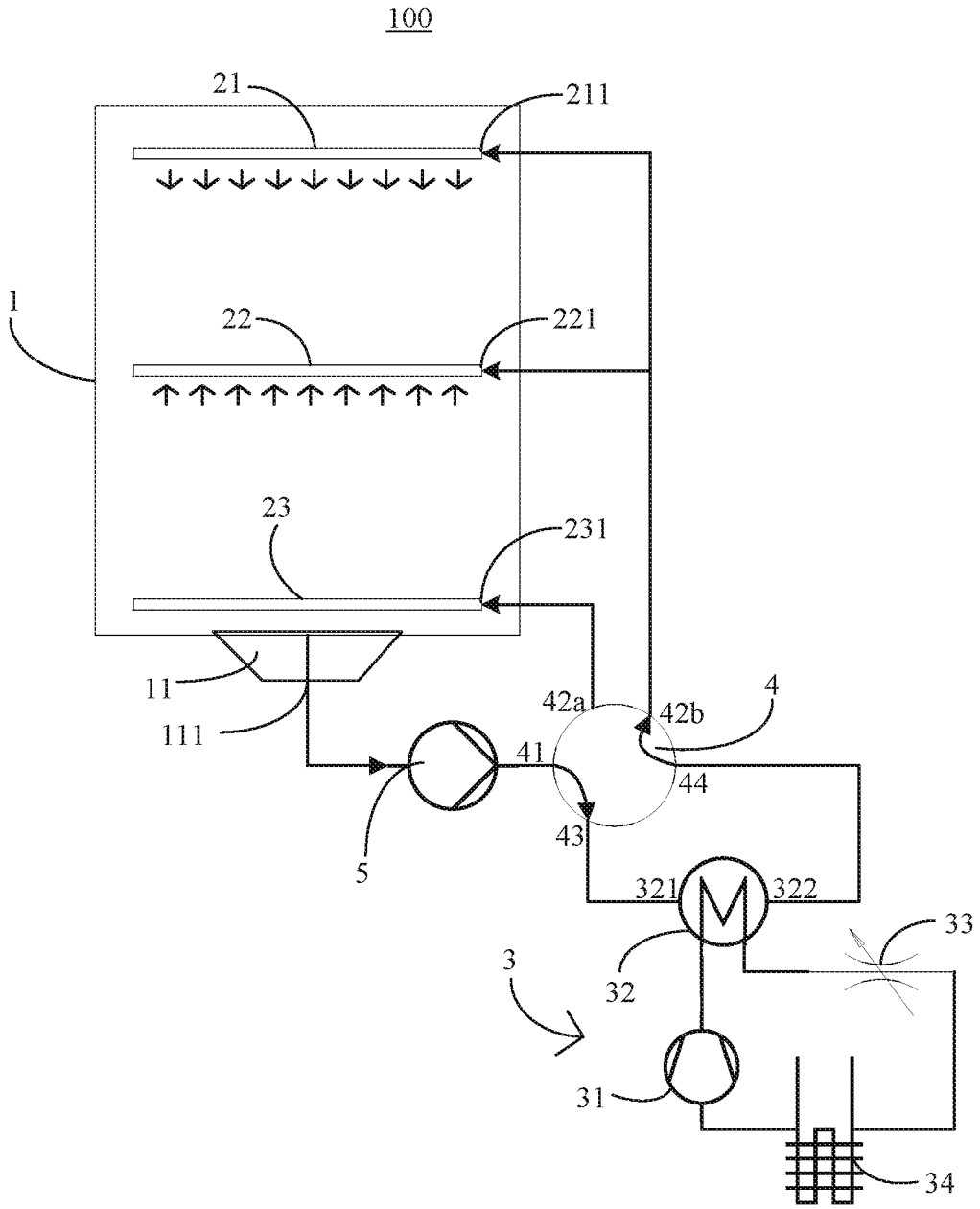
FIG. 27 is a systematic schematic diagram of a dishwasher in a fifth spray cleaning mode according to the present disclosure.

As shown in FIG. 27, in a heating mode, the valve sheet communicates the water inlet 41 with the first water outlet 43 and communicates the water return port 44 with the second water outlet 42*b* on the right, and blocks the second water outlet 42*a* on the left, so that the dishwasher 100 can realize a spray cleaning mode of the lower spray arm 23, the upper spray arm 21, and the middle spray arm 22 in the heating situation.

Figure 28:
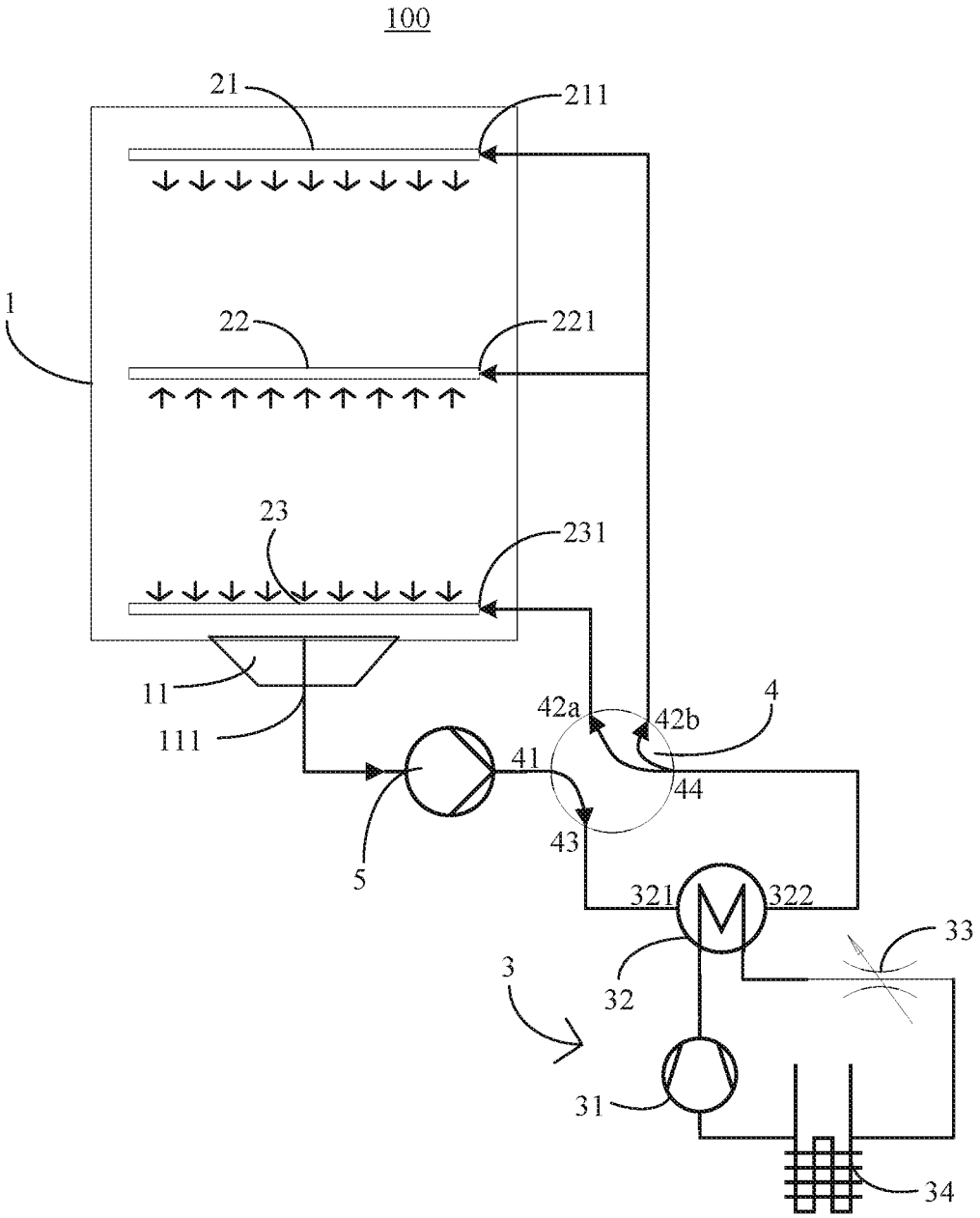
FIG. 28 is a systematic schematic diagram of a dishwasher in a sixth spray cleaning mode according to the present disclosure.

As shown in FIG. 28, in a heating mode, the valve sheet communicates the water inlet 41 with the first water outlet 43, and communicates the water return port 44 with the second water outlet 42*a* on the left and the second water outlet 42*b* on the right, so that the dishwasher 100 can realize a simultaneous spray cleaning mode of the upper spray arm 21, the middle spray arm 22, and the lower spray arm 23 in the heating situation.

In conclusion, for the dishwasher 100 according to the present disclosure, during the non-heating period, the water does not flow through the heating device 3 (the condenser 32), which can reduce the resistance pressure drop in the water flow system during the non-heating period and improve the washing performance of the system. During the heating period, the dishwasher 100 can still adopt the cleaning mode that different spray arms spray alternately, which can reduce the water consumption of the system effectively. In addition, the water diversion function is completely integrated in one diverter valve 4 in the system, such that the structure is compact, the pipeline is shortened, and the control method is simple.

A second embodiment according to the present disclosure will be described below.

The dishwasher 100 according to the embodiment of the present disclosure includes an upper spray arm 21, a middle spray arm 22, and a lower spray arm 23. A spray inlet 211 of the upper spray arm 21 and a spray inlet 221 of the middle spray arm 22 do not merge. Three second water outlets are provided and connected to a spray inlet 231 of the lower spray arm 23, the spray inlet 211 of the upper spray arm 21, and the spray inlet 221 of the middle spray arm 22, respectively. Therefore, the diverter valve 4 can realize a six-way six-path mode, and achieve seven alternate cleaning modes in the non-heating mode: a spray cleaning mode of the lower spray arm 23; a spray cleaning mode of the middle spray arm 22; a spray cleaning mode of the lower spray arm 23; a simultaneous spray cleaning mode of the upper spray arm 21 and the middle spray arm 22; a simultaneous spray cleaning mode of the upper spray arm 21 and the lower spray arm 23; a simultaneous spray cleaning mode of the lower spray arm 23 and the middle spray arm 22; a simultaneous spray cleaning mode of the upper spray arm 21, the middle spray arm 22 and the lower spray arm 23. Similarly, in the heating mode, the above seven alternate cleaning modes can also be realized. As a result, in this embodiment, there are fourteen alternate cleaning modes in total.

The structure of the diverter valve 4 in this embodiment is more complicated, but the above technical effects can still be achieved. That is, during the non-heating period, the water does not flow through the heating device 3 (the condenser 32), which can reduce the resistance pressure drop in the water flow system during the non-heating period and improve the washing performance of the system. During the heating period, the dishwasher 100 can still adopt the cleaning mode that different spray arms spray alternately, which can reduce the water consumption of the system effectively. In addition, the water diversion function is completely integrated in one diverter valve 4 in the system, such that the structure is compact, the pipeline is shortened, and the control method is simple.

A third embodiment according to the present disclosure will be described below.

The dishwasher 100 according to the embodiment of the present disclosure includes an upper spray arm 21, a middle spray arm 22, and a lower spray arm 23. The diverter valve 4 is provided with one second water outlet. A spray inlet 211 of the upper spray arm 21, a spray inlet 221 of the middle spray arm 22, and a spray inlet 231 of the lower spray arm 23 merge into the second water outlet of the diverter valve 4. The diverter valve 4 adopts a six-way six-path form, so that a cleaning mode that the upper spray arm 21, the middle spray arm 22, and the lower spray arm 23 simultaneously spray in the heating situation can be achieved, and a cleaning mode that the upper spray arm 21, the middle spray arm 22, and the lower spray arm 23 simultaneously spray in the non-heating situation can be achieved. In such a case, the design of the diverter valve 4 will be further simplified, which can achieve the purpose of reducing the resistance pressure drop in the water flow system during the non-heating period.

A fourth embodiment according to the present disclosure will be described below.

The dishwasher 100 according to the embodiment of the present disclosure includes any two of an upper spray arm 21, a middle spray arm 22, and a lower spray arm 23. There are two second water outlets, and the two second water outlets are connected to two spray arms correspondingly. Hence, a cleaning mode that the two spray arms alternately spray in heating and non-heating modes can be realized.

By way of example, the washing inner container 1 of the dishwasher 100 may be provided with the lower spray arm 23 and the middle spray arm 22, and the upper spray arm 21 is not provided. Two second water outlets are provided, one of the two second water outlets is connected to a spray inlet 231 of the lower spray arm 23, and the other one thereof is connected to a spray inlet 221 of the middle spray arm 22. Hence, three alternate cleaning modes in the non-heating mode can be realized: a spray cleaning mode of the upper spray arm 21; a spray cleaning mode of the middle spray arm 22; a simultaneous spray cleaning mode of the upper spray arm 21 and the middle spray arm 22. Similarly, in the heating mode, the above three alternate cleaning modes can also be realized. As a result, in this embodiment, there are six alternate cleaning modes in total.

A fifth embodiment according to the present disclosure will be described below.

The dishwasher 100 according to the embodiment of the present disclosure includes any two of an upper spray arm 21, a middle spray arm 22, and a lower spray arm 23. There is one second water outlet, and the two spray arms are both connected to the second water outlet, so that a spray cleaning mode of double spray arms in the heating mode and the non-heating mode can be realized. As a result, in this embodiment, there are two washing modes in total, namely a heating double spray arm washing mode, and a non-heating double spray arm washing mode.

A sixth embodiment according to the present disclosure will be described below.

In the dishwasher 100 according to the embodiment of the present disclosure, the washing inner container 1 may be provided with only one of a lower spray arm 23, a middle spray arm 22, and an upper spray arm 21. There may be one second water outlet, and the second water outlet is connected to the one of the lower spray arm 23, the middle spray arm 22, and the upper spray arm 21, so that a spray cleaning mode of single spray arm in the heating mode and the non-heating mode can be realized. As a result, in this embodiment, there are two washing modes in total, namely a heating single spray arm washing mode, and a non-heating single spray arm washing mode.

Therefore, for the dishwasher 100 according to the embodiments of the present disclosure, by providing the diverter valve 4, the washing water can be diverted in different washing modes. In the non-heating mode, the washing water does not flow through the heating device 3, which can reduce the flow resistance in the water flow system during the non-heating period to a certain extent, speed up the water flow, improve the cleaning speed and cleanliness, and upgrade the system washing performance. Moreover, in the non-heating mode, the turn-on or turn-off of the heating device 3 and the flow path of the washing water can be independently controlled, so that the use of the dishwasher 100 becomes more convenient. In addition, the water diversion function is integrated in one diverter valve 4, so that the water diversion structure is compact, the pipeline is shortened, and the control method is simple.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Various embodiments and examples are provided in the following description to implement different structures of the present disclosure. In order to simplify the present disclosure, elements and settings of certain examples are described in the above. Certainly, these elements and settings are only by way of example and are not intended to limit the present disclosure. In addition, reference numerals and/or letters may be repeated in different examples in the present disclosure. This repetition is for the purpose of simplification and clarity and does not indicate relations between different embodiments and/or settings. Furthermore, examples of different processes and materials are provided in the present disclosure. However, it would be appreciated by those skilled in the art that other processes and/or materials may be also applied.

Reference throughout this specification to "an embodiment," "some embodiments," "an exemplary embodiment," "an example," "a specific example," or "some examples," means that a particular feature, structure, material, or characteristic described in connection with the embodiment or example is included in at least one embodiment or example of the present disclosure. Thus, the appearances of these phrases in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that various changes, modifications, alternatives and variations can be made in the embodiments without departing from principles and purposes of the present disclosure. The scope of the present disclosure is defined by the claims and their equivalents.

What is claimed is:

1. A diverter valve assembly comprising:

a housing defining a water diversion chamber in the housing, and provided with a water inlet, a water return port, a first water outlet, and a second water outlet; and a diverter valve provided in the water diversion chamber and capable of partitioning the water diversion chamber into a first water diversion chamber and a second water diversion chamber, wherein the first water diversion chamber is in communication with the water inlet, wherein the diverter valve is rotatable in the water diversion chamber to provide a first operational configuration of the diverter valve and a second operational configuration of the diverter valve, and wherein:

at the first operational configuration, the first water diversion chamber is in communication with the water inlet and the first water outlet and the second water diversion chamber is in communication with the second water outlet and the water return port, wherein the first water outlet is in communication with the water return port to allow water discharged from the first water outlet to enter the second water diversion chamber through the water return port; and at the second operational configuration, the water inlet is blocked from the first water outlet and the first water diversion chamber is in communication with the water inlet and the second water outlet.

2. The diverter valve assembly according to claim 1, wherein the diverter valve comprises a first baffle, and the first baffle is capable of opening or closing the first water outlet when the diverter valve rotates.

3. The diverter valve assembly according to claim 2, wherein the first baffle is provided with a water through hole, and when the diverter valve rotates, the first baffle is capable of communicating the first water outlet with the first water diversion chamber by means of the water through hole.

4. The diverter valve assembly according to claim 1, wherein the diverter valve has a partition baffle, the partition baffle partitions the water diversion chamber into the first water diversion chamber and the second water diversion chamber, and the partition baffle is capable of rotating in the water diversion chamber to communicate the water inlet with the first water outlet or block the water inlet from the first water outlet.

5. The diverter valve assembly according to claim 4, wherein the partition baffle comprises a baffle body and two baffle connecting pieces connected to both sides of the baffle body, and the two baffle connecting pieces are each attached to an inner wall of the water diversion chamber.

6. The diverter valve assembly according to claim 5, wherein the baffle connecting pieces are arcuately connected to the inner wall of the water diversion chamber.

7. The diverter valve assembly according to claim 1, wherein the diverter valve comprises a second baffle, and the second baffle is capable of opening or closing the second water outlet when the diverter valve rotates.

8. The diverter valve assembly according to claim 7, wherein a plurality of second water outlets are provided, a plurality of second baffles are provided, and the number of the second baffles is identical to the number of the second water outlets.

9. The diverter valve assembly according to claim 8, wherein two second water outlets are provided, and two second baffles are provided; the two second water outlets are spaced apart from each other, and the two second baffles are spaced apart from each other.

10. The diverter valve assembly according to claim 7, wherein the diverter valve comprises a fixing portion, and the second baffle is detachably mounted to the fixing portion.

11. The diverter valve assembly according to claim 10, wherein:

the housing is provided with a channel, and the channel is communicated with the second water outlet;

the second baffle comprises a bottom plate and a first fitting portion extending upwards from the bottom plate;

the fixing portion is formed with a second fitting portion fitted with the first fitting portion; and when the diverter valve rotates, the second baffle is capable of opening or closing an entrance of the channel through the bottom plate to open or close the second water outlet.

12. The diverter valve assembly according to claim 1, wherein the diverter valve comprises a third baffle, and the third baffle is capable of opening or closing the water return port when the diverter valve rotates.

13. The diverter valve assembly according to claim 1, wherein the diverter valve assembly comprises a driving mechanism, and the driving mechanism is connected to the diverter valve and configured to drive the diverter valve to rotate.

14. The diverter valve assembly according to claim 13, wherein:

the diverter valve assembly comprises a sensor;

the driving mechanism comprises a driving portion and a transmission portion;

the transmission portion is configured to connect the driving portion to the diverter valve and comprises a transmission member; and the sensor is configured to detect a position of the transmission member.

15. The diverter valve assembly according to claim 14, wherein:

the driving portion comprises an electric motor;

the diverter valve comprises a driving rod, and the driving rod extends downwards from a top of the diverter valve; and the diverter valve is connected to the transmission member through the driving rod.

16. The diverter valve assembly according to claim 1, wherein the housing comprises a lower housing and an upper housing, and the lower housing is connected to the upper housing.

17. The diverter valve assembly according to claim 16, wherein:

the lower housing is provided with the water inlet, the water return port, and the second water outlet; and the upper housing is provided with the first water outlet.

18. A household appliance comprising:

a diverter valve assembly comprising:

a housing defining a water diversion chamber in the housing, and provided with a water inlet, a water return port, a first water outlet, and a second water outlet; and a diverter valve provided in the water diversion chamber and capable of partitioning the water diversion chamber into a first water diversion chamber and a second water diversion chamber, wherein the first water diversion chamber is in communication with the water inlet, wherein the diverter valve is rotatable in the water diversion chamber to provide a first operational configuration of the diverter valve and a second operational configuration of the diverter valve, and wherein at the first operational configuration, the first water diversion chamber is in communication with the water inlet and the first water outlet and the second water diversion chamber is in communication with the second water outlet and the water return port; and at the second operational configuration, the water inlet is blocked from the first water outlet and the first water diversion chamber is in communication with the water inlet and the second water outlet;

a chamber body defining a chamber therein;

a spray arm at least partially provided in the chamber, the second water outlet being connected to the spray arm; and a heating device connected to the first water outlet and the water return port.

19. A dishwasher comprising:

a washing inner container provided with a washing outlet;

at least one spray arm disposed in the washing inner container and provided with a spray inlet;

a heating device configured to heat washing water, and having a to-be-heated water inlet and a heated water outlet; and a diverter valve provided with a water inlet, a first water outlet, a second water outlet, and a water return port, wherein the water inlet is connected to the washing outlet, the second water outlet is connected to the spray inlet, the first water outlet is connected to the to-be-heated water inlet, and the water return port is connected to the heated water outlet, wherein the dishwasher comprises at least two working modes: in a first mode, the water inlet of the diverter valve is communicated with the second water outlet; in a second mode, the water inlet of the diverter valve is communicated with the first water outlet, and the water return port is communicated with the second water outlet.

20. The dishwasher according to claim 19, wherein a plurality of spray arms are provided, and the spray inlet of each spray arm is communicated with the second water outlet.

21. The dishwasher according to claim 19, wherein a plurality of spray arms are provided, a plurality of second water outlets are provided, and each second water outlet is communicated with the spray inlet of at least one spray arm.

22. The dishwasher according to claim 19, wherein:

a plurality of second water outlets are provided;

in the first mode, the water inlet is selectively communicated with at least one second water outlet; and in the second mode, the water return port is selectively communicated with at least one second water outlet.

23. The dishwasher according to claim 19, wherein:

two second water outlets are provided;

in the first mode, the water inlet is communicated with one of the second water outlets, or the water inlet is communicated with the other one of the second water outlets, or the water inlet is simultaneously communicated with both of the second water outlets; and in the second mode, the water return port is communicated with one of the second water outlets, or the water inlet is communicated with the other one of the second water outlets, or the water inlet is simultaneously communicated with both of the second water outlets.

24. The dishwasher according to claim 19, wherein the spray arm comprises:

a lower spray arm provided at a lower part inside the washing inner container;

an upper spray arm provided at an upper part inside the washing inner container; and a middle spray arm provided at a middle part inside the washing inner container.

25. The dishwasher according to claim 24, wherein:

two second water outlets are provided;

a spray inlet of the lower spray arm is communicated with one of the second water outlets; and a spray inlet of the upper spray arm and a spray inlet of the middle spray arm are communicated with the other one of the second water outlets.

26. The dishwasher according to claim 24, wherein three second water outlets are provided, and the three second water outlets are connected to a spray inlet of the lower spray arm, a spray inlet of the upper spray arm, and a spray inlet of the middle spray arm, respectively.

27. The dishwasher according to claim 19, wherein the heating device comprises a compressor, a condenser, a throttling device, and an evaporator that are sequentially connected end to end to constitute a refrigerant cycle.

28. The dishwasher according to claim 27, wherein:

the condenser defines a first liquid flow channel and a second liquid flow channel in the condenser;

two ends of the first liquid flow channel are provided with the to-be-heated water inlet and the heated water outlet, respectively; and two ends of the second liquid flow channel are communicated with the compressor and the throttling device, respectively.

* * * * *